US010323478B2

(12) United States Patent
Berscheidt et al.

(10) Patent No.: US 10,323,478 B2
(45) Date of Patent: Jun. 18, 2019

(54) MODULAR INSERT FLOAT SYSTEM

(71) Applicant: ANGLER CEMENTING PRODUCTS, L.P., Houston, TX (US)

(72) Inventors: Kevin Berscheidt, Marlow, OK (US); Michael Sutton, Houston, TX (US); Cleo Holland, Markow, OK (US)

( * ) Notice: Subject to any disclaimer, the term of this patent is extended or adjusted under 35 U.S.C. 154(b) by 192 days.

(21) Appl. No.: 15/459,948

(22) Filed: Mar. 15, 2017

(65) Prior Publication Data

US 2018/0266206 A1 Sep. 20, 2018

(51) Int. Cl.

| | |
|---|---|
| ***E21B 33/129*** | (2006.01) |
| ***E21B 17/14*** | (2006.01) |
| ***E21B 33/14*** | (2006.01) |
| ***E21B 23/01*** | (2006.01) |
| ***E21B 34/10*** | (2006.01) |
| ***E21B 33/128*** | (2006.01) |
| ***E21B 34/00*** | (2006.01) |

(52) U.S. Cl.

CPC ..... *E21B 33/1293* (2013.01); *E21B 17/14* (2013.01); *E21B 23/01* (2013.01); *E21B 33/128* (2013.01); *E21B 33/1294* (2013.01); *E21B 33/14* (2013.01); *E21B 34/10* (2013.01); *E21B 2034/005* (2013.01)

(58) Field of Classification Search

CPC ..... E21B 33/1293; E21B 17/14; E21B 33/14; E21B 33/1294; E21B 23/01; E21B 34/10; E21B 33/128; E21B 2034/005; E21B 33/134; E21B 33/129; E21B 21/10; E21B 33/13

See application file for complete search history.

(56) References Cited

U.S. PATENT DOCUMENTS

| | | | | |
|---|---|---|---|---|
| 4,600,058 | A | 7/1986 | Van Wormer et al. | |
| 4,641,707 | A * | 2/1987 | Akkerman | E21B 34/102 166/116 |
| 4,901,794 | A | 2/1990 | Baugh et al. | |
| 4,934,459 | A | 6/1990 | Baugh et al. | |
| 5,379,835 | A | 1/1995 | Streich | |
| 5,542,483 | A | 8/1996 | Edman | |
| 5,960,881 | A | 10/1999 | Allamon et al. | |
| 5,964,297 | A | 10/1999 | Edman | |
| 6,497,291 | B1 | 12/2002 | Szarka | |
| 7,090,004 | B2 | 8/2006 | Warren et al. | |
| 7,617,879 | B2 | 11/2009 | Anderson et al. | |

(Continued)

OTHER PUBLICATIONS

"Liner Hanger Systems", 2010, p. 81, Baker Hughes Incorporated.

*Primary Examiner* — Wei Wang
(74) *Attorney, Agent, or Firm* — Chamberlain Hrdlicka

(57) ABSTRACT

The present disclosure provides a modular insert float system and method that can be inserted into a casing and attached to the casing internal surface by internal slips and sealing components. The system is modular in that three main components: an upper valve assembly, a lower valve assembly, and a pair of casing anchor and seal assemblies along with top and bottom shoes form a kit that can be used for virtually any casing of a given size regardless of the threads, casing material grades, length of joint, or other variations. Further, the system allows for insertion of the casing into the wellbore without damaging the formation from forcing wellbore fluid into the formation and causing the loss of wellbore fluid in the wellbore.

15 Claims, 33 Drawing Sheets

(56) References Cited

U.S. PATENT DOCUMENTS

| | | | | |
|---|---|---|---|---|
| 7,644,774 | B2 | 1/2010 | Branch et al. | |
| 2004/0060700 | A1 * | 4/2004 | Vert | E21B 7/20<br>166/291 |

* cited by examiner

MODULAR INSERT FLOAT SYSTEM

CROSS REFERENCE TO RELATED APPLICATIONS

Not applicable.

STATEMENT REGARDING FEDERALLY SPONSORED RESEARCH OR DEVELOPMENT

Not applicable.

REFERENCE TO APPENDIX

Not applicable.

BACKGROUND OF THE INVENTION

Field of the Invention

This disclosure relates to float valves used for hydrocarbon wells when conducting cementing operations. More specifically, this disclosure relates to float valves capable of being inserted within a casing.

Description of the Related Art

In the oil and gas industry, there is a need for equipment to cement casing into a drilled wellbore for hydrocarbon production from a well. Casing is usually inserted into the wellbore with "floating equipment" threaded onto the end of the casing (known as a "float shoe") and/or threaded between pieces of casing often at the end of the casing string (known as "float collars"). This floating equipment has check valves built into their assemblies that will eventually prevent fluid (often, pumped cement) from entering into the casing by backing up after it has been pumped from the surface, down the internal bore of the casing, and up the annular space between the casing and the drilled hole of the wellbore. The heavier fluids being pumped downhole would tend to flow back up into the casing if the float valves were not in place. The float valves block the flow back into the casing, so that the cement in the annulus is held in place until the cement can set up hard, creating a protective barrier around the casing OD.

Most all floating equipment currently in use must have matching threads in order to make up the bodies of the float equipment to the thread profiles on the casing for the wellbore that forms a "string" of joints and connections. While standard threads exist, many operators prefer various proprietary threads that may offer strength, reduced torque to make up the connection, or other features for a given application. The different thread types are many. In addition to the matching threads, the float equipment is generally required to match the type of materials for the casing to ensure strength and performance of the casing string. There are many grades of steel and alloys available. These requirement alone make it an arduous task for users of float equipment to ensure all floating equipment matches the casing specifically.

Some efforts have been made to avoid the need of matching casing threads by inserting floating equipment into the bore of the casing. For example, U.S. Pat. No. 5,379,835 teaches in its abstract, "Insert type floating equipment valves for use in the cementing of casing in oil and gas wells and the like which may be retained in the casing therein through the use of slips or set screws or anchors and uses either cup type or compression type sealing members." Another example is in U.S. Pat. No. 6,497,291 that teaches, "An improved float valve according to the present invention includes a packer 10 for positioning within a joint of the casing C while at the surface of the well, the packer including a float valve receptacle therein for at least partially receiving a float valve. The float valve body includes a valve seat 56 and a valve member 54 is positioned for selective engagement and disengagement with the valve seat. A guide nose 58 may be optionally provided for positioning within the casing joint between the valve body and the pin end of the casing joint. The float valve body may be reliably fixed and sealed to the packer body. After the packer setting operation, the casing joint and the packer and the float valve may then be positioned as an assembly within the well." In both examples of inserted float equipment, the float valve is spring-loaded in a normally closed position and the fluid must overcome the spring force to open the valve. Further, there has to be a sufficient flow area between the valve and the seat without undue pressure drop, and the interface between the seat and the valve must be clear to reseal after the fluid passes through to avoid back flow. Because these systems are closed during insertion down the casing, wellbore fluid in the casing is pushed out from the inside of the casing and can cause excessive installation pressure on the float equipment and tooling that inserts the float equipment. The excessive pressure can also cause damage to the surrounding formation and hinder hydrocarbon production. Further, the absence of the wellbore fluid inside the casing can cause collapse from the pressure outside the casing.

Therefore, there remains a need for a float system that can be inserted into a casing, provide sufficient flow area for the fluid to flow through the valve without undue pressure drop, and reliably seal when the flow is finished to avoid back flow.

BRIEF SUMMARY OF THE INVENTION

The present disclosure provides a modular insert float system and method that can be inserted into a casing and attached to the casing internal surface by internal slips and sealing components. The system is modular in that three main components: an upper valve assembly, a lower valve assembly, and a pair of casing anchor and seal assemblies along with top and bottom shoes form a kit that can be used for virtually any casing of a given size regardless of the threads, casing material grades, length of joint, or other variations. Further, the system allows for insertion of the casing into the wellbore without damaging the formation from forcing wellbore fluid into the formation and causing the loss of wellbore fluid in the wellbore.

The disclosure provides a modular insert float system, comprising: a casing anchor and seal assembly, comprising: a mandrel having two interchangeable ends configured to allow a downhole component to be coupled to either end; a sealing element coupled to mandrel; and a slip coupled to the mandrel on each side of the sealing element. The system can also comprise a lower assembly formed from the casing anchor and seal assembly and a lower valve assembly, the lower valve assembly comprising: a lower valve housing; and a valve coupled to the lower valve housing; the lower assembly being configured to be coupled to an inside bore of a casing independent of being coupled to a casing end. The system can also comprise an upper assembly formed from the casing anchor and seal assembly and an upper valve assembly, the upper valve assembly comprising: an upper valve housing; and a valve coupled to the upper valve housing; the upper assembly being configured to be coupled to an inside bore of a casing independent of being coupled to a casing end.

The disclosure also provides a modular insert float system, comprising: a lower assembly, and an upper assembly, the lower assembly and upper assembly configured to be coupled to an inside bore of a casing independent of being coupled to a casing end. The lower assembly comprises: a lower valve assembly, comprising: a lower valve housing, and a valve coupled to the lower valve housing; and a lower casing anchor and seal assembly coupled with the lower valve assembly, comprising: a mandrel having two interchangeable ends configured to allow coupling to either end, and a sealing element coupled to mandrel. The upper assembly comprises: an upper valve assembly, comprising: an upper valve housing, and a valve coupled to the upper valve housing; and an upper casing anchor and seal assembly interchangeable with the lower casing anchor and seal assembly, comprising: a mandrel having two interchangeable ends configured to allow coupling to either end, and a sealing element coupled to mandrel.

The disclosure further provides a method of installing a modular insert float system into a bore of a casing, the float system having an assembly having a valve assembly with a valve housing, and a valve coupled with the valve housing; and a casing anchor and seal assembly having a mandrel with two interchangeable ends, and a sealing element coupled to mandrel; the method comprising: installing a downhole component on either interchangeable end of the casing anchor and seal assembly; inserting the casing anchor and seal assembly and downhole component a predetermined distance into the bore of the casing; and setting the casing anchor and seal assembly to engage the bore of the casing independent of being coupled to a casing end.

The disclosure also provides a method of installing a modular insert float system into a bore of a casing, the float system having: a lower assembly having a lower valve assembly with a lower valve housing, and a valve coupled with the lower valve housing; an upper assembly having an upper valve assembly with an upper valve housing, a valve coupled with the upper valve housing: and an upper casing anchor and seal assembly interchangeable with a lower casing anchor and seal assembly, each casing anchor and seal assembly, having a mandrel with two interchangeable ends and a sealing element coupled to mandrel; the method comprising: installing a bottom shoe on either end of the lower casing anchor and seal assembly; inserting the lower casing anchor and seal assembly a predetermined distance into the bore of the casing; setting the lower casing anchor and seal assembly to engage the bore of the casing independent of being coupled to a casing end; coupling an end of the lower casing anchor and seal assembly distal from the bottom shoe to the lower valve assembly; installing the upper valve assembly on either end of the upper casing anchor and seal assembly; inserting the upper casing anchor and seal assembly and upper valve assembly a predetermined distance into the bore of the casing; setting the upper casing anchor and seal assembly to engage the bore of the casing independent of being coupled to a casing end; and coupling a top shoe to an end of the upper casing anchor and seal assembly distal from the upper valve assembly.

BRIEF DESCRIPTION OF THE SEVERAL VIEWS OF THE DRAWINGS

FIG. 160 is a schematic end view of the bottom shoe of FIGS. 16A and 16B.

DETAILED DESCRIPTION

Figure 1:
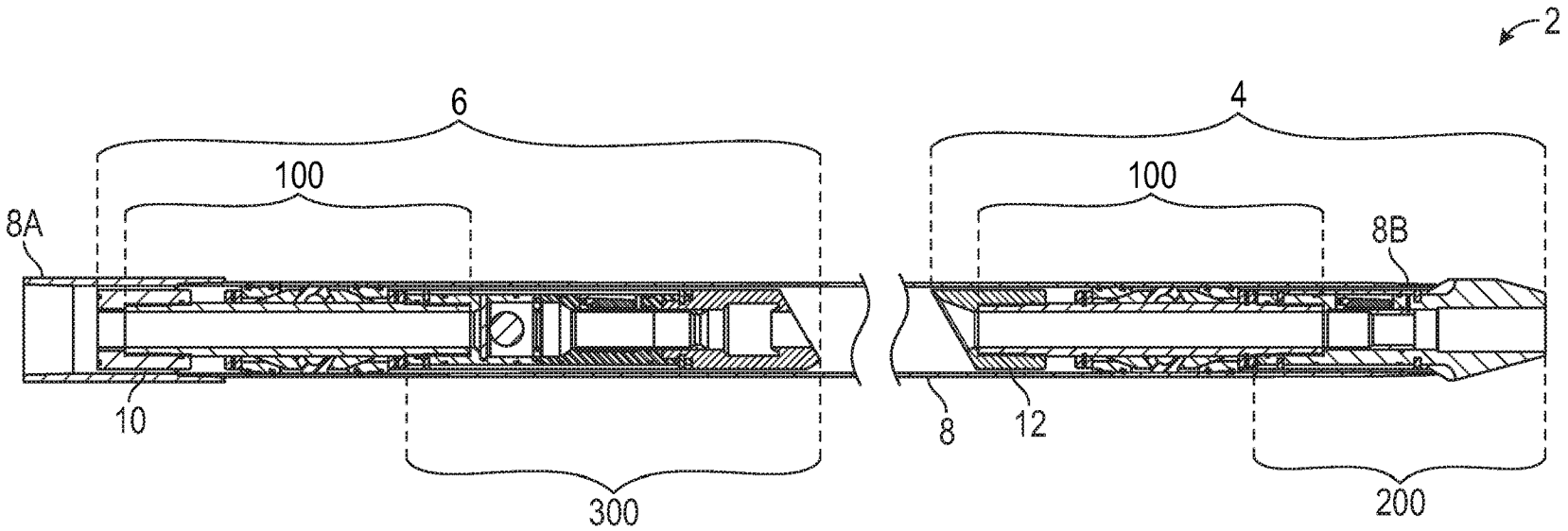
FIG. 1 is a schematic cross sectional view of an exemplary modular insert float system within a casing.

The Figures described above with the written description of exemplary structures and functions below are not presented to limit the scope of what the inventor(s) have invented or the scope of the appended claims. Rather, the Figures and written description are provided to teach any person skilled in the art to make and use the inventions for which patent protection is sought. Those skilled in the art will appreciate that not all features of a commercial embodiment of the inventions are described or shown for the sake of clarity and understanding. Persons of skill in this art will also appreciate that the development of an actual commercial embodiment incorporating aspects of the present disclosure will require numerous implementation-specific decisions to achieve the developer's ultimate goal for the commercial embodiment. Such implementation-specific decisions may include, and likely are not limited to, compliance with system-related, business-related, government-related and other constraints, which may vary by specific implementation and location from time to time. While a developer's efforts might be complex and time-consuming in an absolute sense, such efforts would be, nevertheless, a routine undertaking for those of ordinary skill in this art having benefit of this disclosure. It must be understood that the inventions disclosed and taught herein are susceptible to numerous and various modifications and alternative forms.

The use of a singular term, such as, but not limited to, "a," is not intended as limiting of the number of items. Also, the use of relational terms, such as, but not limited to, "top," "bottom," "left," "right," "upper," "lower," "down," "up," "side," and like terms are used in the written description for clarity in specific reference to the Figures as would be viewed in a typical orientation of a system installation, and are not intended to limit the scope of the invention or the appended claims. Generally, left to right in the Figures is upper to lower in the casing. For ease of cross reference among the Figures, elements are labeled in various Figures even though the actual textual description of a given element may be detailed in some other Figure. Further, the various methods and embodiments of the system can be included in combination with each other to produce variations of the disclosed methods and embodiments. Discussion of singular elements can include plural elements and vice-versa. References to at least one item may include one or more items. Also, various aspects of the embodiments could be used in conjunction with each other to accomplish the understood goals of the disclosure. Unless the context requires otherwise, the word "comprise" or variations such as "comprises" or "comprising" should be understood to imply the inclusion of at least the stated element or step or group of elements or steps or equivalents thereof, and not the exclusion of a greater numerical quantity or any other element or step or group of elements or steps or equivalents thereof. The device or system may be used in a number of directions and orientations. The terms such as "coupled", "coupling", "coupler", and like are used broadly herein and may include any method or device for securing, binding, bonding, fastening, attaching, joining, inserting therein, forming thereon or therein, communicating, or otherwise associating, for example, mechanically, magnetically, electrically, chemically, operably, directly or indirectly with intermediate elements, one or more pieces of members together and may further include without limitation integrally forming one functional member with another in a unity fashion. The coupling may occur in any direction, including rotationally. The order of steps can occur in a variety of sequences unless otherwise specifically limited. The various steps described herein can be combined with other steps, interlineated with the stated steps, and/or split into multiple steps. Similarly, elements have been described functionally and can be embodied as separate components or can be combined into components having multiple functions.

The present disclosure provides a modular insert float system and method that can be inserted into a casing and attached to the casing internal surface by internal slips and sealing components. The system is modular in that three main components: an upper valve assembly, a lower valve assembly, and a pair of casing anchor and seal assemblies along with top and bottom shoes form a kit that can be used for virtually any casing of a given size regardless of the threads, casing material grades, length of joint, or other variations. Further, the system allows for insertion of the casing into the wellbore without damaging the formation from forcing wellbore fluid into the formation and causing the loss of wellbore fluid in the wellbore.

FIG. 1 is a schematic cross sectional view of an exemplary modular insert float system within a casing. The modular insert float system 2 generally includes two assemblies: a lower assembly 4 and an upper assembly 6. The lower assembly 4 generally includes a lower casing anchor and seal assembly (CAASA) 100 coupled with a lower valve assembly 200. The upper assembly 6 generally includes an upper CAASA 100 coupled with an upper valve assembly 300. The lower and upper CAASAs can be the same or similar for modularity and interchangeability between the lower and upper assemblies. A CAASA bottom shoe 12 can be coupled to the lower CAASA 100 in the lower assembly 4. Similarly, CAASA top shoe 10 can be coupled to upper CAASA 100 of the upper assembly 6. The components described above can be coupled using slips and seals to the internal bore of one or more casing joints, herein singularly or collectively "a casing" 8. The term "casing" is used broadly to include casing, drill pipe, and other tubular goods. The casing 8 has ends and, without limitation, the ends generally have male and female threads for attaching a plurality of casing joints together to form a casing string for insertion down a wellbore with the float system. The female threaded end is termed a "collar end" 8A and the male threaded end is termed a "pin end" 8B. Generally, the pin end is inserted into the wellbore with the collar end following, so that the pin end is the lower end in the wellbore. The lower and upper assemblies 4 and 6 do not need attachment to each other and therefore can be flexibly installed within the casing and even within different casings to extend a distance between the assemblies. The float system herein is modular in that three main components: a pair of interchangeable CAASAs 100, the lower valve assembly 200, the upper valve assembly 300, along with top and bottom shoes 10 and 12, form a kit that can be used for virtually any casing of a given size regardless of the threads, casing material grades, length of joint, or other variations.

Figure 2A:
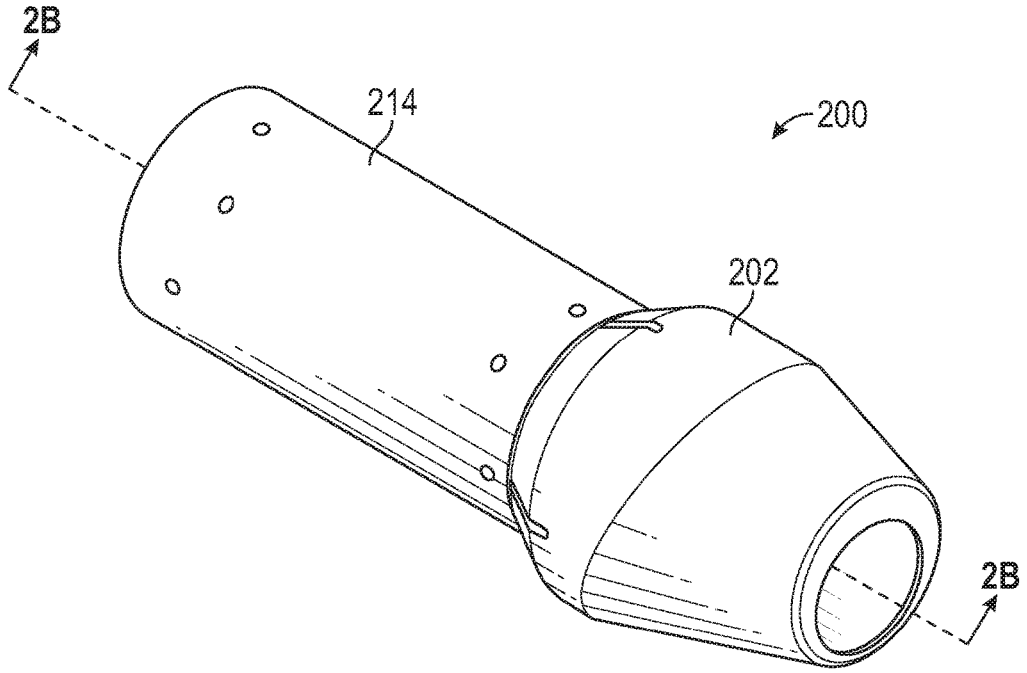
FIG. 2A is a schematic perspective view of the lower valve assembly of the float system of FIG. 1.
Figure 2B:
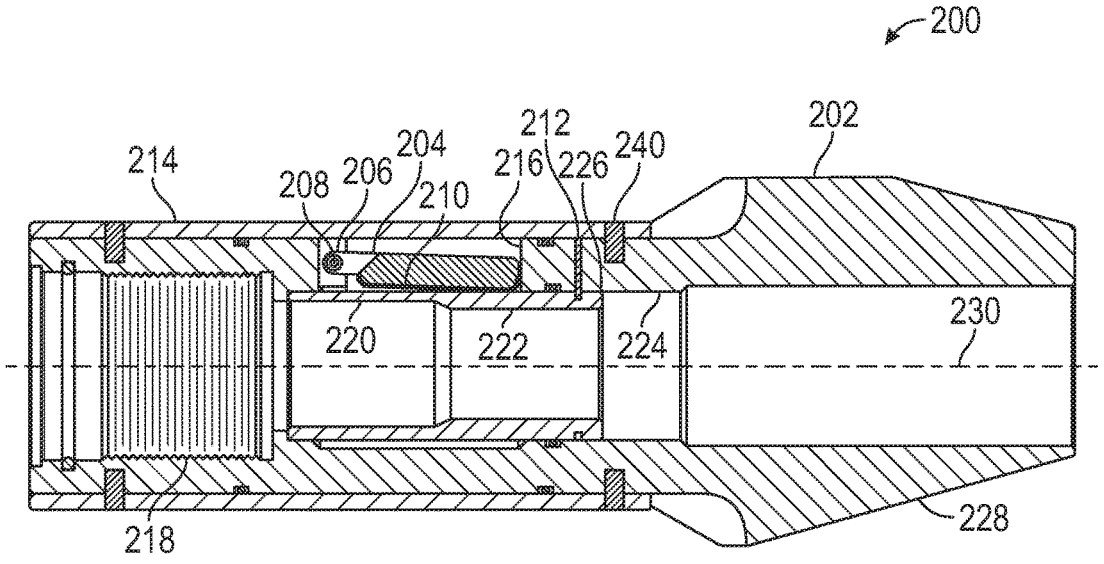
FIG. 2B is a schematic cross sectional view of the lower valve assembly of FIG. 2A.
Figure 3A:
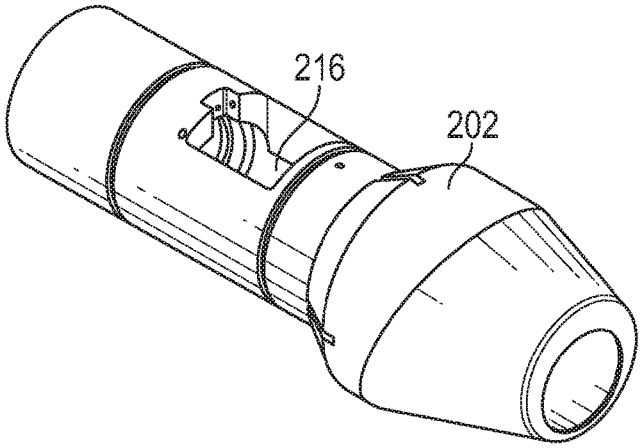
FIG. 3A is a schematic perspective view of a housing of the lower valve assembly of FIG. 2A with a flapper slot formed in the housing.
Figure 3B:
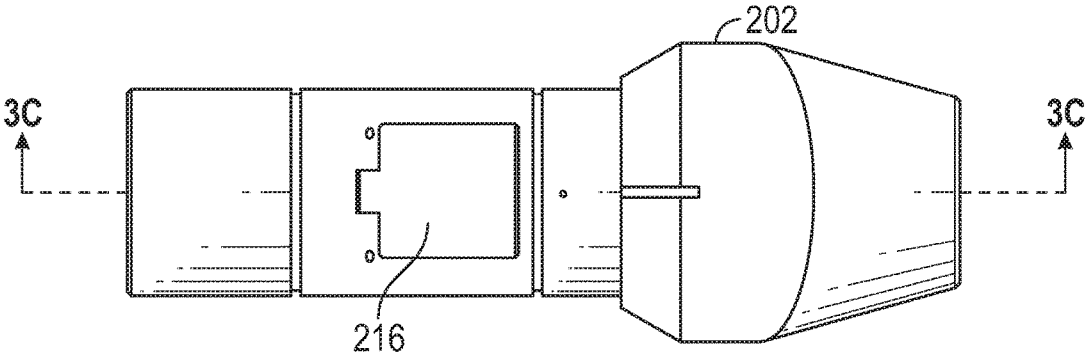
FIG. 3B is a schematic top view of the housing of FIG. 3A.
Figure 3C:
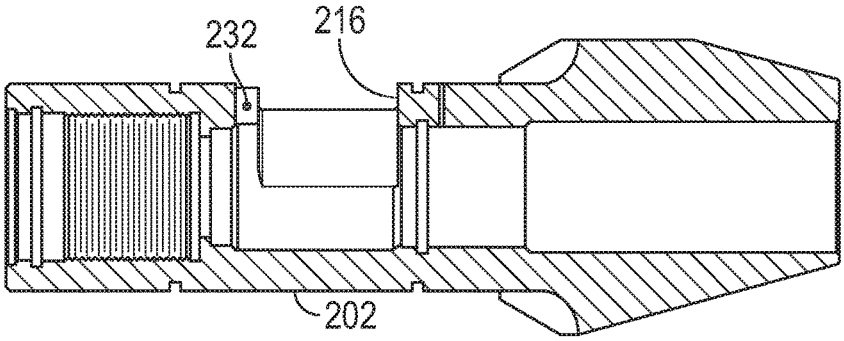
FIG. 3C is a schematic cross sectional side view of the housing of FIG. 3A.
Figure 4A:
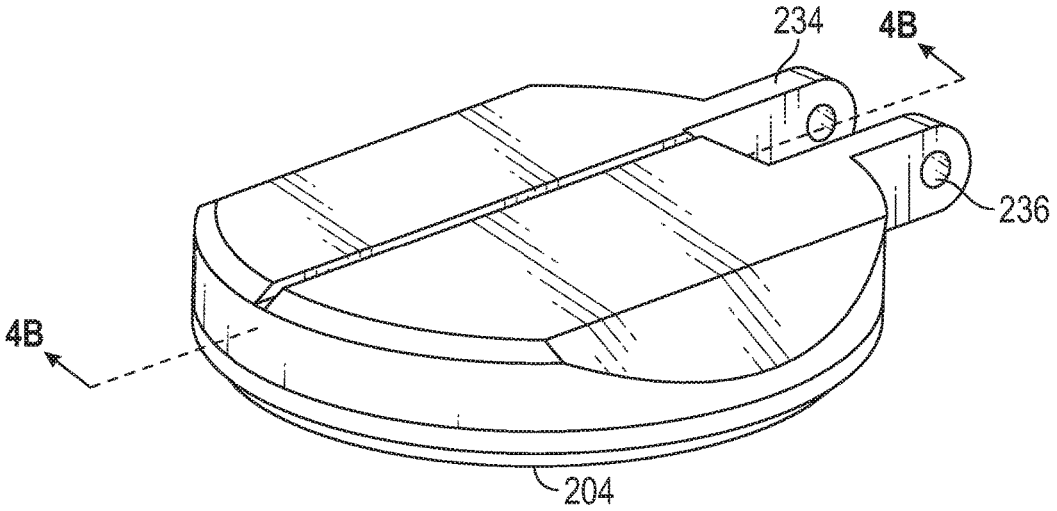
FIG. 4A is a schematic perspective view of an exemplary flapper valve.
Figure 4B:
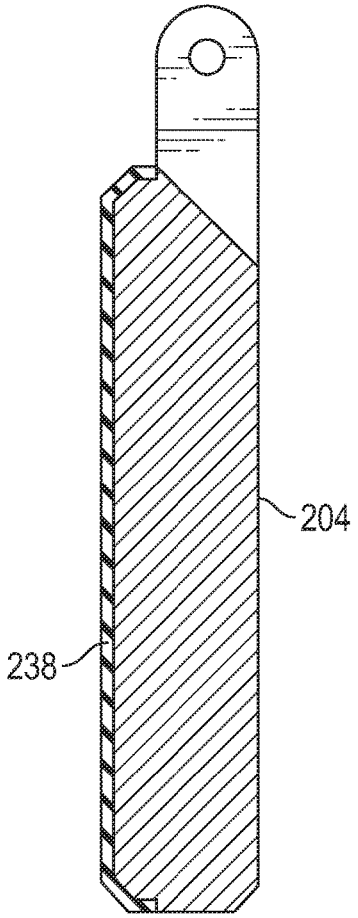
FIG. 4B is a schematic cross sectional view of the flapper valve of FIG. 4A.

FIGS. 2A-4B illustrate an assembly and various components of an exemplary lower valve assembly. FIG. 2A is a schematic perspective view of the exemplary lower valve assembly of the float system shown in FIG. 1. FIG. 2B is a schematic cross sectional view of the lower valve assembly of FIG. 2A. FIG. 3A is a schematic perspective view of a housing of the lower valve assembly of FIG. 2A with a flapper slot formed in the housing, FIG. 3B is a schematic top view of the housing of FIG. 3A. FIG. 3C is a schematic cross sectional side view of the housing of FIG. 3A. FIG. 4A is a schematic perspective view of an exemplary flapper valve. FIG. 4B is a schematic cross sectional view of the flapper valve of FIG. 4A. The lower valve assembly 200 generally includes a lower valve housing 202 coupled with a case 214 that at least partially encapsulates the components. The case can be coupled to the housing with one or more fastening pins or other restraining elements 240, including screws, such as set screws, adhesive applied to the relative components, and the like, and can be removable.

The lower valve housing 202 is formed with a bore 224 and includes a lower end with a taper 228. The taper 228 can be formed off-center from a longitudinal centerline 230. A slot 216 with a recess can be formed in the wall of the housing 202. A flapper valve 204 having a pair of flapper arms 234 with a pin opening 236 can be rotatably coupled to the housing within the slot with a pin 208 inserted into a pin opening 232 of the slot. The flapper valve can be biased into a closed position that is generally transverse to a bore 224 of the lower valve housing 202 by a bias element 206. An elastomeric seal 238 can be formed on the body of the flapper valve 204 to assist in sealing the flapper valve in operation.

A sliding sleeve 210 can be slidably disposed within the housing bore 224. The sleeve 210 has an outer periphery 226 that is slightly smaller than the housing bore 224, so that it can slide within the bore 224 when activated. The sliding sleeve 210 is formed with a first bore 220 and a second bore 222 that is smaller in cross-sectional area than the first bore. The smaller second bore 222 is configured lower than the first bore 220 when the valve assembly is installed in the casing for purposes described herein. The sleeve 210 is held in position temporarily by a restraining element 212 that is inserted through the housing 202. The restraining element 212 can be sheared or otherwise dislodged between the restrained components when sufficient pressure is exerted on the system as described below. The sleeve 210 is coupled in the housing bore 224 at a longitudinal position that blocks the flapper valve 204 from rotating to the biased closed position, generally transverse to the housing bore 224. If the flapper valve 204 is held open during installation of the casing into the wellbore (termed "run in"), the fluid in the wellbore can automatically fill the casing and avoid formation damage, casing collapse, and other detrimental effects. This capability, described herein as an "auto-fill" feature, can be activated with the flapper valve held open or can be deactivated so that the flapper valve is closed to block fluid from coming up the casing through the valve assembly during run in. An upper end of the lower valve assembly 200 is formed with a threaded bore 218 for coupling with the CAASA 100 described above. Various seals such as O-rings and other seals can be used to restrict leakage between the components, as would be known to those with ordinary skill in the art.

Figure 5A:
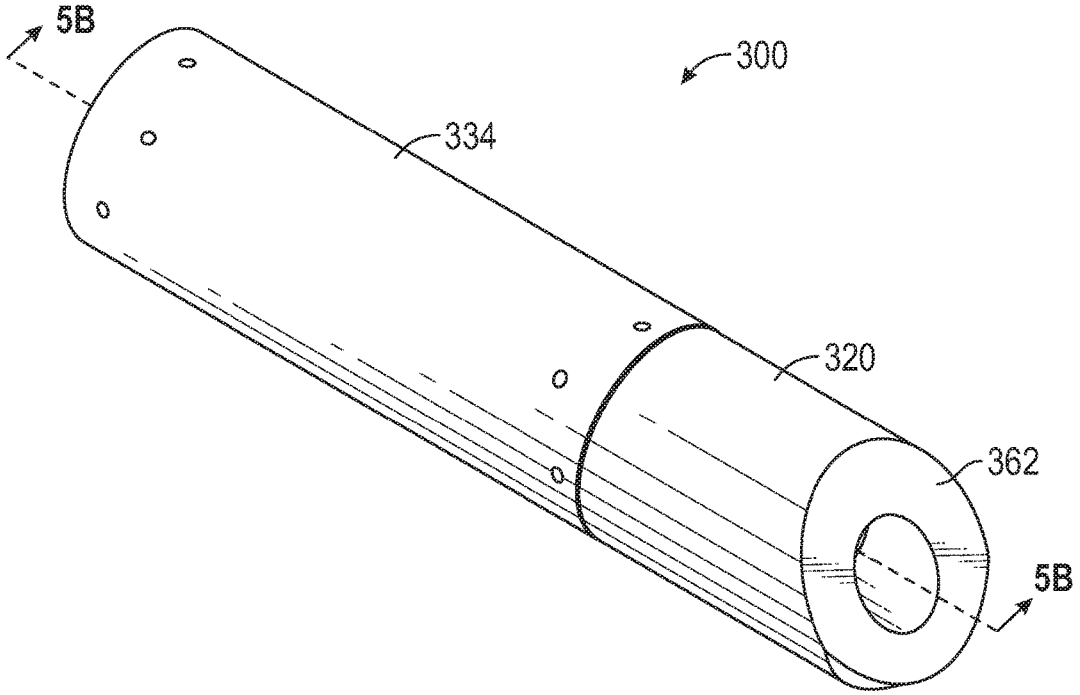
FIG. 5A is a schematic perspective view of the upper valve assembly of the float system of FIG. 1.
Figure 5B:
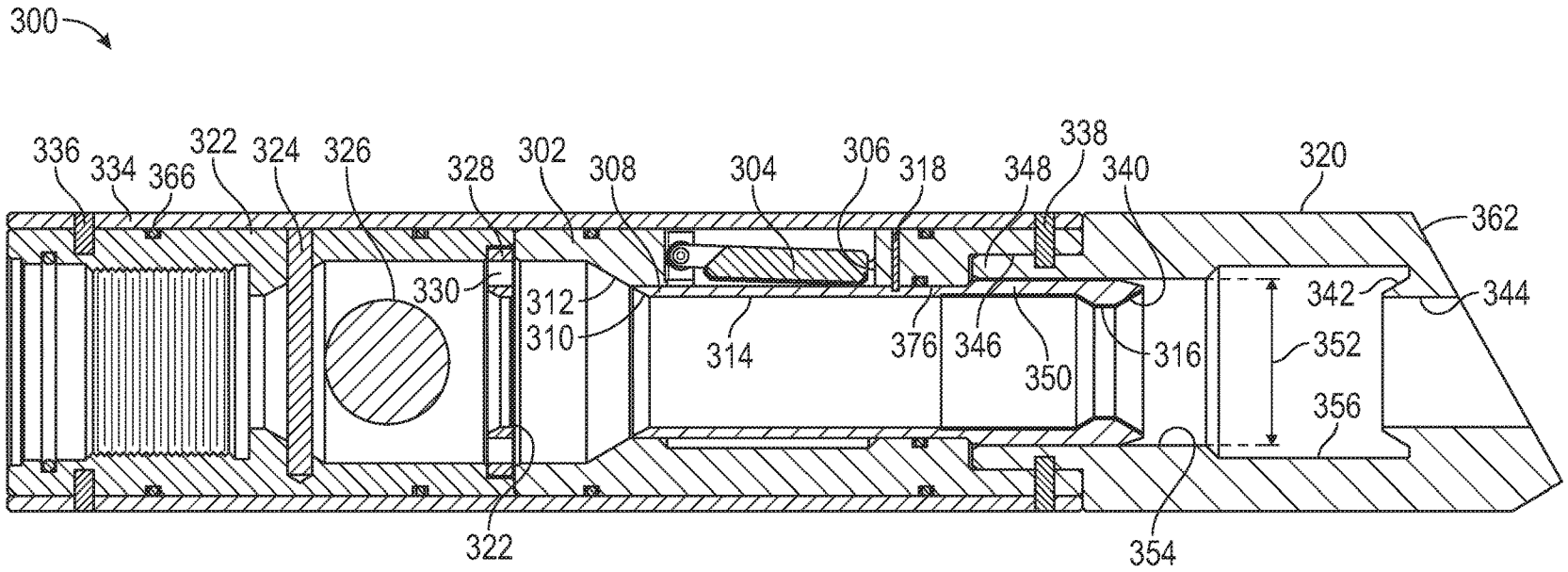
FIG. 5B is a schematic cross sectional view of the upper valve assembly of FIG. 5A.
Figure 6A:
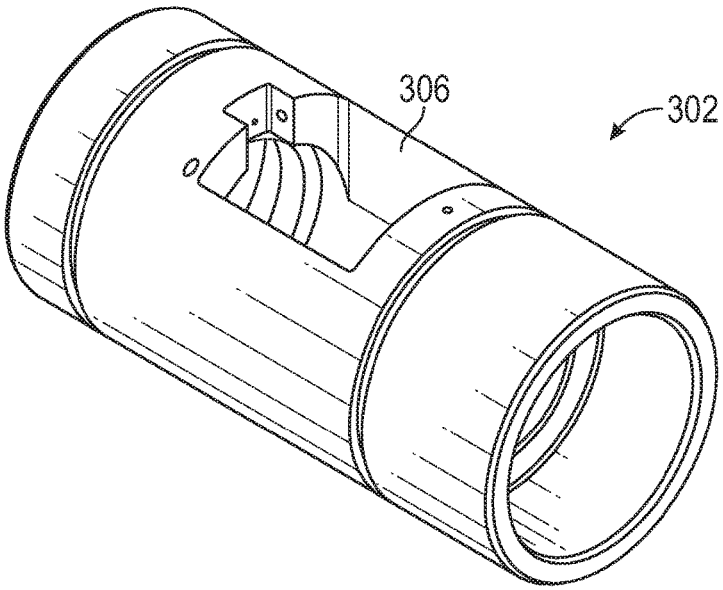
FIG. 6A is a schematic perspective view of a housing of the upper valve assembly of FIG. 5A with a flapper slot formed in the housing.
Figure 6B:
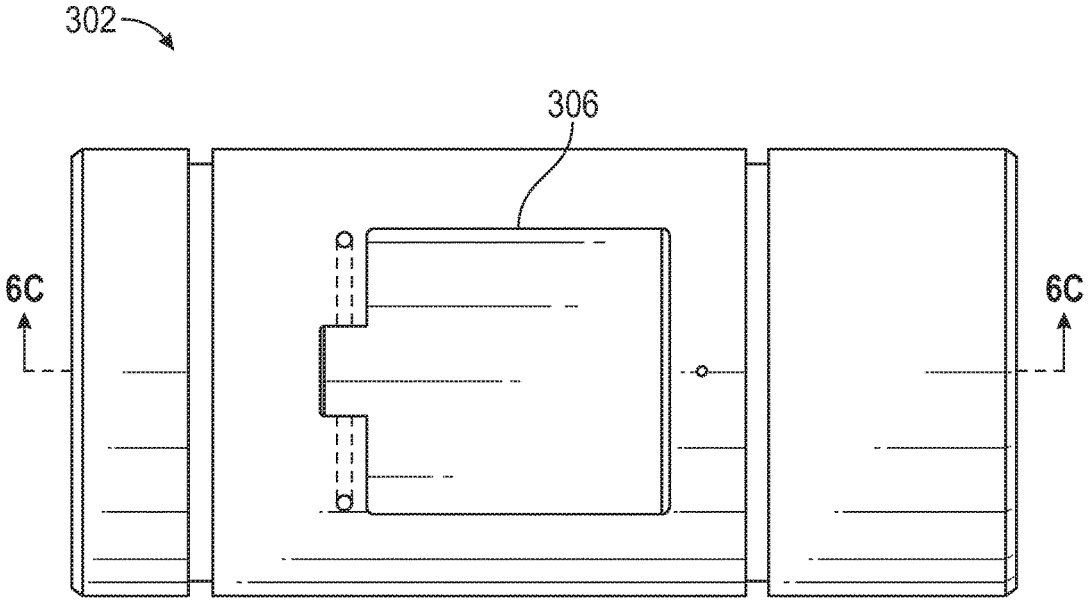
FIG. 6B is a schematic top view of the housing of FIG. 6A.
Figure 6C:
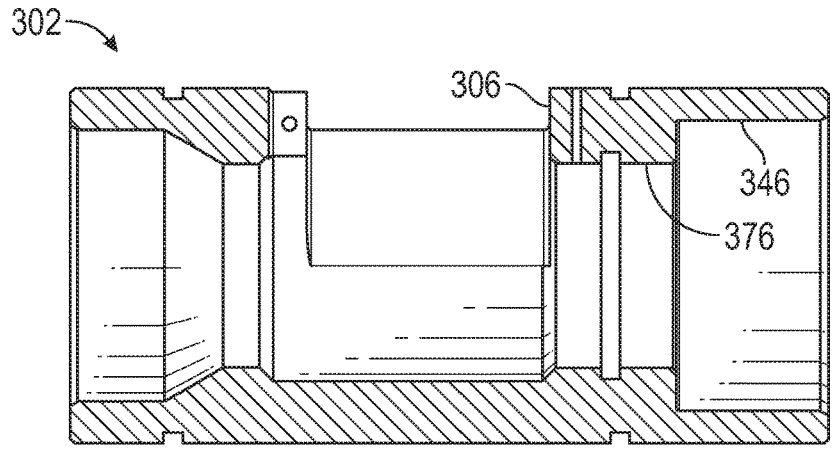
FIG. 6C is a schematic cross sectional side view of the housing of FIGS. 6A and 6B.
Figure 10A:
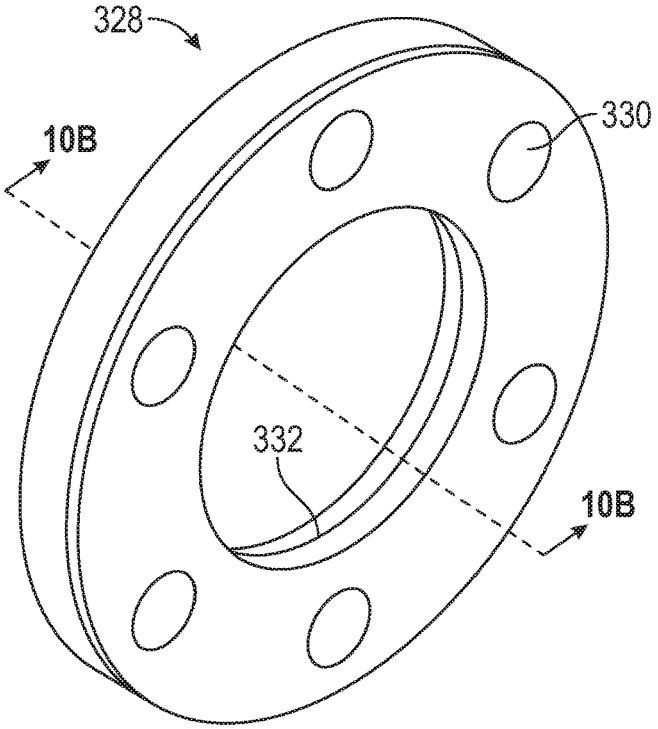
FIG. 10A is a schematic perspective of a ball restrictor plate for the upper valve assembly.
Figure 10B:
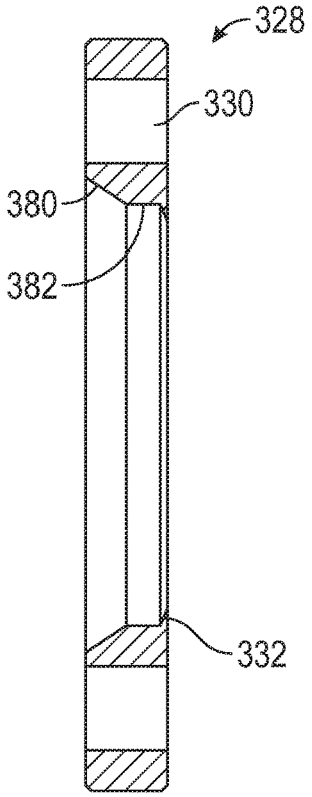
FIG. 10B is a schematic cross sectional view of the ball restrictor plate of FIG. 10A.

FIGS. 5A-10B illustrate an assembly and various components of an exemplary upper valve assembly 300, FIG. 5A is a schematic perspective view of the exemplary upper valve assembly of the float system shown in FIG. 1. FIG. 5B is a schematic cross sectional view of the upper valve assembly of FIG. 5A. FIG. 6A is a schematic perspective view of a housing of the upper valve assembly of FIG. 5A with a flapper slot formed in the housing. FIG. 6B is a schematic top view of the housing of FIG. 6A. FIG. 6C is a schematic cross sectional side view of the housing of FIGS. 6A and 6B. FIG. 7A is a schematic perspective view of a shoe for the upper valve assembly. FIG. 7B is a schematic cross sectional view of the shoe of FIG. 7A. FIG. 8A is a schematic perspective view of a sliding sleeve for the upper valve assembly. FIG. 8B is a schematic end view of the sliding sleeve of FIG. 8A showing locations of exemplary cross sections. FIG. 8C is a schematic cross sectional view of the sliding sleeve of FIGS. 8A and 8B. FIG. 8D is another schematic cross sectional view of the sliding sleeve of FIGS. 8A and 8B. FIG. 9A is a schematic perspective view of a ball holder for the upper valve assembly, FIG. 9B is a schematic cross sectional view of the ball holder of FIG. 9A, FIG. 10A is a schematic perspective of a ball restrictor plate for the upper valve assembly. FIG. 10B is a schematic cross sectional view of the ball restrictor plate of FIG. 10A. In at least one embodiment, the upper valve assembly 300 can include a housing 302 with associated components and a case 334 as a cover. Further, the upper valve assembly 300 can include an upper valve assembly shoe 320 coupled to the housing 302. In at least one embodiment, the housing 302 can be coupled to the upper valve assembly shoe 320 and the case 334 with a restraining element 338, such as pin, set screw, adhesive applied to the components and other restraining elements.

More specifically, the housing 302 can include a housing shoe bore 346 formed to receive a shoe extension 348 of the upper valve assembly shoe 320. The housing 302 can further include a slot 306 formed through a wall of the housing. The slot 306 forms an opening for a flapper valve 304 to be rotatably coupled to the housing and biased toward a sealing position across a housing sleeve bore 376. The slot 306 and flapper valve 304 can be similar to the slot 216 and the flapper valve 204, as described above. The flapper valve 304 can be biased to a closed position, so that when the sleeve is removed, the flapper valve can travel to a sealing position transverse to the longitudinal axis of the bore 376.

Figure 8A:
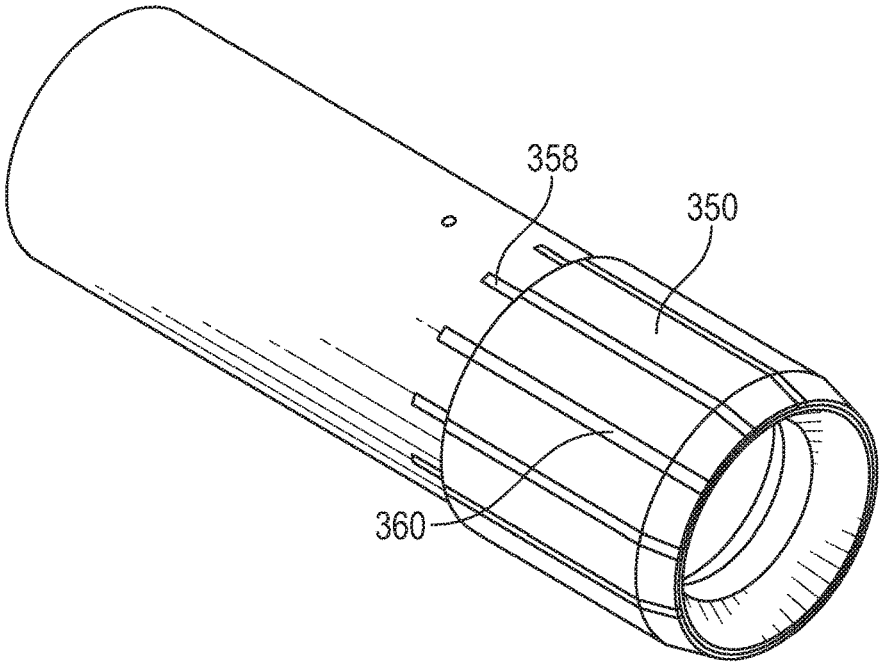
FIG. 8A is a schematic perspective view of a sliding sleeve for the upper valve assembly.
Figure 8B:
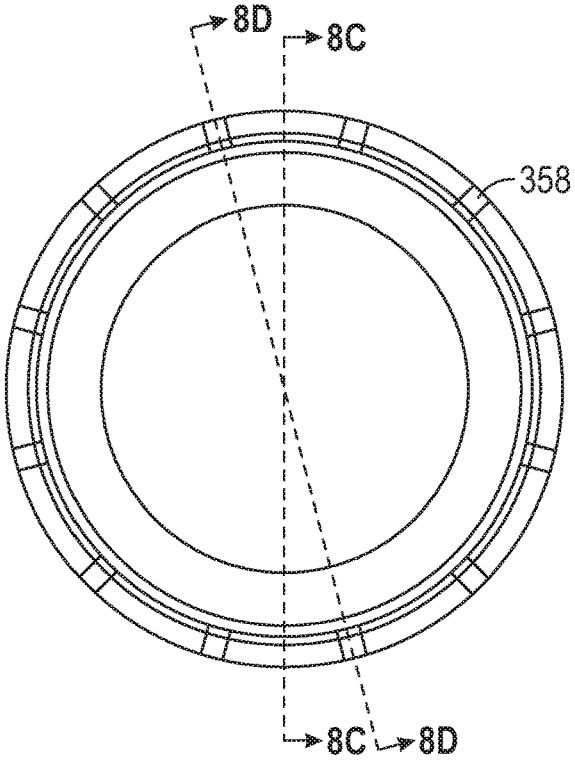
FIG. 8B is a schematic end view of the sliding sleeve of FIG. 8A showing locations of exemplary cross sections.
Figure 8C:
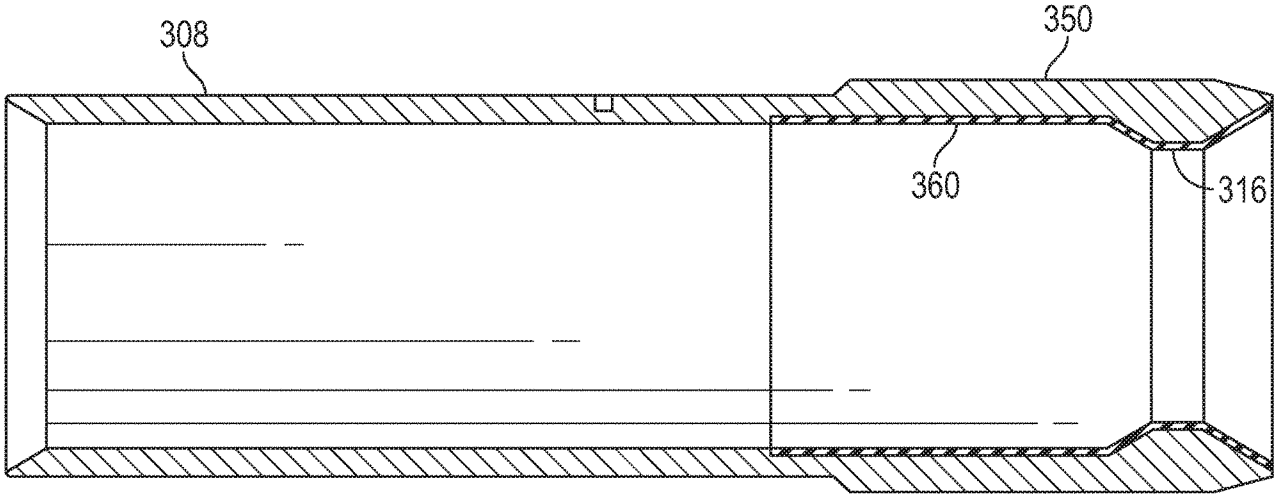
FIG. 8C is a schematic cross sectional view of the sliding sleeve of FIGS. 8A and 8B.
Figure 8D:
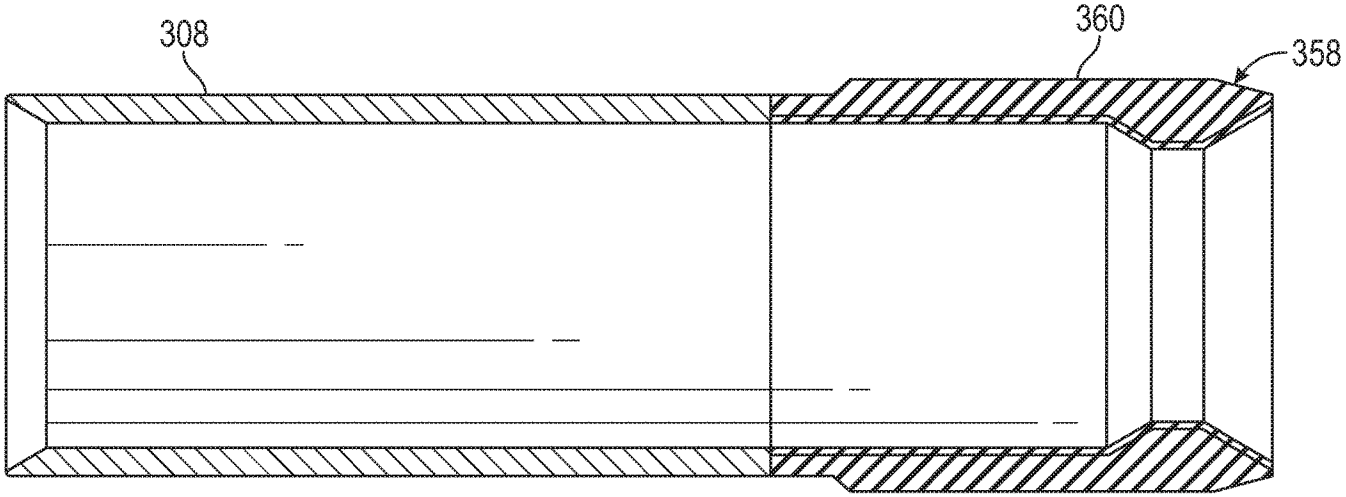
FIG. 8D is another schematic cross sectional view of the sliding sleeve of FIGS. 8A and 8B.
Figure 9A:
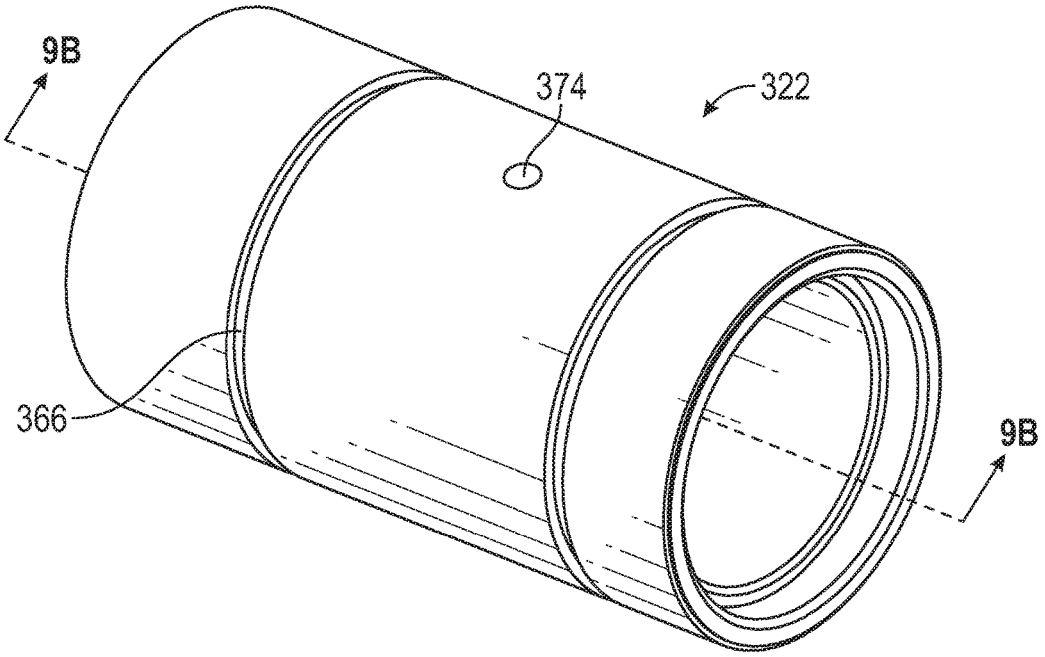
FIG. 9A is a schematic perspective view of a ball holder for the upper valve assembly.
Figure 9B:
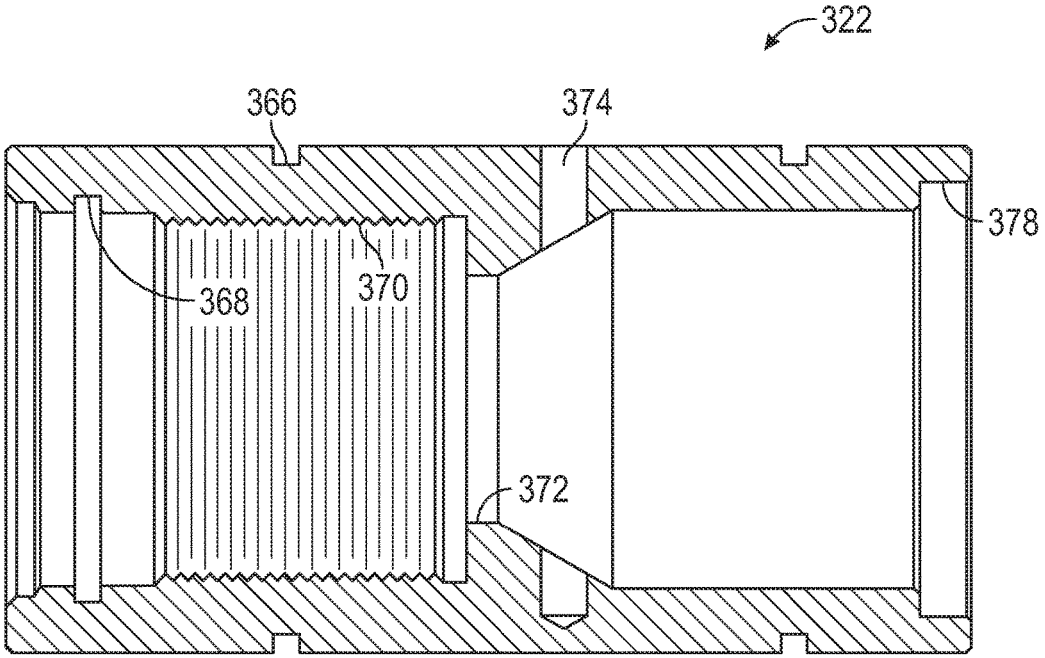
FIG. 9B is a schematic cross sectional view of the ball holder of FIG. 9A.

A sliding sleeve 308 can be inserted into a housing sleeve bore 376 of the housing. The sliding sleeve outer periphery can be slightly less than the bore 376 to allow the sliding sleeve 308 to slide longitudinally when activated. The sliding sleeve can be coupled into a position longitudinally with a restraining element 318 that can restrain the flapper valve 304 from actuating and sealing across the housing sleeve bore 376. Further, the sliding sleeve can include a taper 310 that can align with a corresponding taper 312 in the housing. The tapers can facilitate a ball 326 or other actuator in alignment in the internal bore 314 of the sliding sleeve for actuation of the valve assemblies as described herein. The sliding sleeve can further include slotted sleeve fingers 350, shown in more detail in FIGS. 8A-8D. The slotted sleeve fingers 350 are generally on a lower end of the sliding sleeve, so that the ball 326 can travel down the sleeve bore 314 of the sliding sleeve to engage the slotted fingers until the ball is restrained when it engages a ball catch 316 at the lower end of the slotted fingers 350. The slotted fingers can be filled and sealed with an elastomeric material 360, as shown in FIGS. 8C-8D to assist in creating a sealing surface against which pressure is applied to on the ball to activate the upper valve assembly.

A ball holder 322 is disposed in the upper valve assembly 300 above the upper valve housing 302. The ball holder can be restrained in position by a restraining element 336 coupled to the case 334. With the upper valve housing 302 coupled to the case 334 with the restraining element 338 and the ball holder 322 also coupled to the case with the restraining element 336, then the upper valve housing 302 is coupled with the ball holder 322. The ball holder 322 includes a threaded bore that can engage the CAASA 100 shown in FIG. 1, A seal groove 368 can be formed above the threaded bore 370 to accept a seal, such as an O-ring, and seal against the CAASA when inserted into the bore. One or more other seal grooves 366 on an external surface of the ball holder can be similarly used to seal against other surfaces such as the inner periphery of the case 334. (Other seal grooves and seals throughout the system and assemblies can be formed for sealing the components and would be known to those with ordinary skill in the art.) A smaller bore 372 is formed below the threaded bore 370 in the ball holder. The bore 372 is sized for a small clearance of the ball 326 when inserted through the bore 372. A cross opening 374 is formed through the ball holder and can be used with a restraining element 324 to restrict upward movement of the ball after the ball has been inserted into the ball holder. A plate bore 378 is formed toward a lower end of the ball holder. The plate bore 378 can accept the ball restrictor plate 328, shown in FIGS. 5B and 10A-10B. The ball restrictor plate 328 can include a taper 380 that allows flow into a plate receiver bore 382 and then to a plate restrictor 332. The ball restrictor plate 328 can initially hold the ball in position between the cross pin or other restraining element 324 and the plate restrictor 332, shown in FIG. 5B. A plurality of plate passages 330 are formed in the ball restrictor plate 328 to allow flow through the plate while the ball is restricted by the plate restrictor 332, thus generally sealing flow through the plate restrictor 332. Upon insertion into the casing, wellbore fluid can flow up into the upper valve assembly and pass the ball 326 without dislodging the ball from the upper valve assembly because it is held in position by the restraining element 324 for upward flow. Conversely, if downward flow is desired, such as circulation, then the passages 330 of the ball restrictor plate 328 allow downward flow up to a certain pressure without dislodging the ball 326 through the plate restrictor 332.

For operation, if sufficient fluid pressure is applied to the ball 326 from an upper location such from the surface of the well, the pressure can force the ball through the opening of the plate restrictor 332 to become aligned with the sleeve 308 by passing the tapers 312 and 310 to enter the bore 314 of the sleeve until the ball engages the ball catch 316. Additional pressure on the ball can activate the upper valve assembly by forcing the ball to exert a sufficient force on the ball catch 316 to shear or otherwise disengage the restraining element 318 and then to push the sleeve 308 toward the upper valve assembly shoe 320. When the sleeve 308 has cleared the location of the flapper valve 304, the flapper valve can rotate across the housing bore 376 through the slot 306 in the housing and seal against any backflow in a reverse direction from a lower location to an upper location. A housing release bore 356 is formed in the shoe 320 that is of a sufficient diameter to allow the slotted sleeve fingers 350 to expand radially outward and release the ball from the ball catch 316 to travel further down to the lower assembly 4 shown in FIG. 1. A sleeve taper 340 on the sleeve can engage a corresponding shoe taper 342 on the shoe to help the slotted fingers 350 expand radially to release the ball.

Figure 7A:
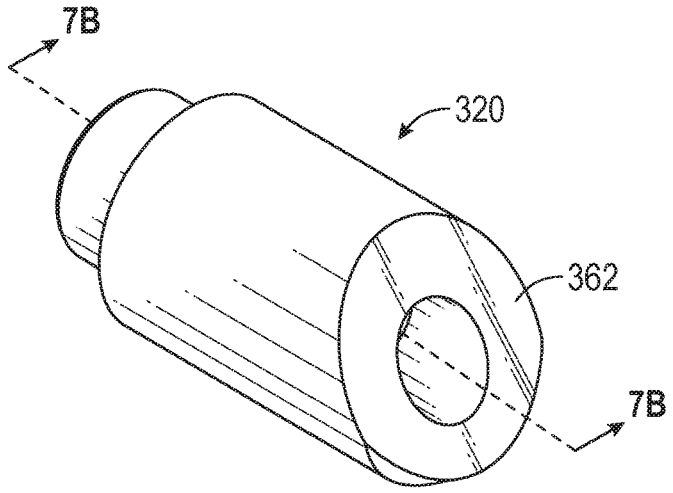
FIG. 7A is a schematic perspective view of a shoe for the upper valve assembly.
Figure 7B:
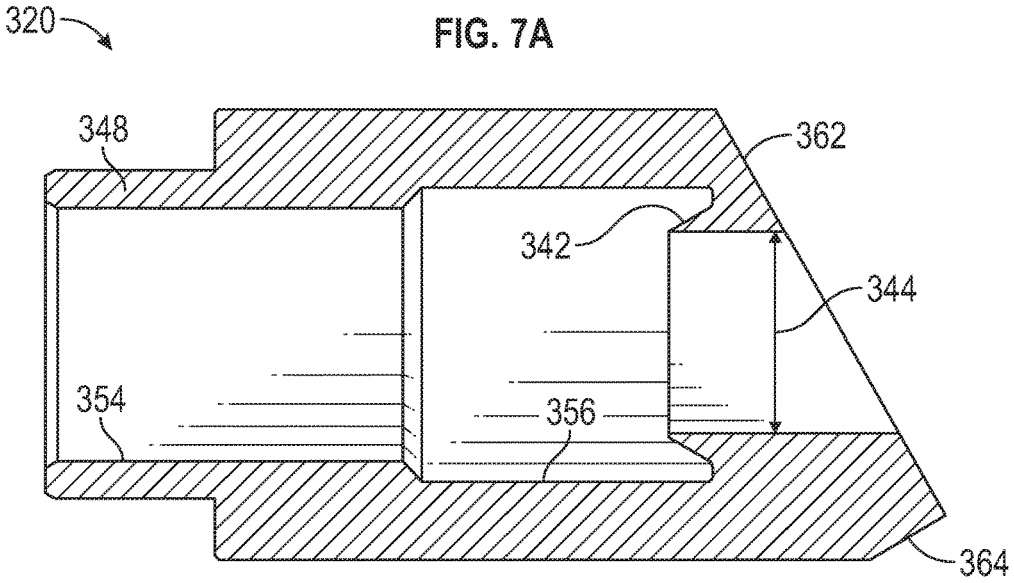
FIG. 7B is a schematic cross sectional view of the shoe of FIG. 7A.

The upper valve assembly shoe 320 also includes a lead taper 362, as shown in FIGS. 7A-7B, that can correspondingly engage a lead taper on the CAASA bottom shoe 12 when drilling out the modular insert float system 2 after the float system has been used to complete cementing operations for the well. A counter taper 364 can be formed on a portion of the lead taper 362 to reduce the edge profile of the lead taper.

Figure 10C:
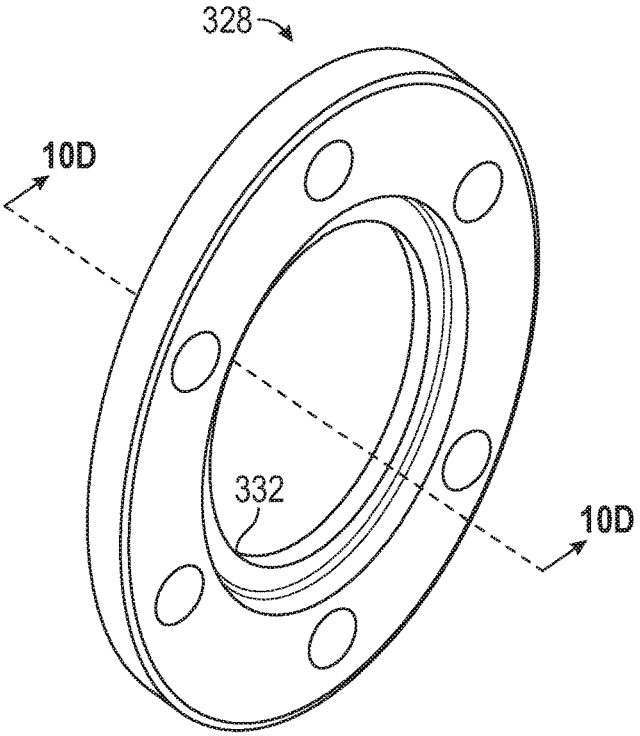
FIG. 10C is a schematic perspective of another exemplary embodiment of a ball restrictor plate for the upper valve assembly for a given pressure release.
Figure 10D:
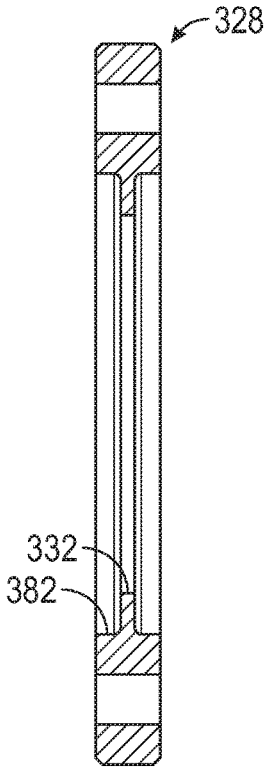
FIG. 10D is a schematic cross sectional view of the ball restrictor plate of FIG. 10C.

FIG. 10C is a schematic perspective of another exemplary embodiment of a ball restrictor plate for the upper valve assembly for a given pressure release. FIG. 10D is a schematic cross sectional view of the ball restrictor plate of FIG. 10C. The embodiment shown in FIGS. 10C and 10D has similar structure and function as the embodiment shown in FIGS. 10A and 10B, but is omnidirectional, that is, the plate can be facing either direction in the flow path. The plate restrictor plate 328 is formed with a plate receiver bore 382 on both sides of the plate restrictor 332. The ball 326, described in FIG. 5B, can locate on the plate restrictor 332 from either side of the plate. Sufficient pressure on the ball can create sufficient force to press the ball through the bore of the plate restrictor 332 by deforming the plate restrictor to allow the ball to pass therethrough.

The bore and width of the plate restrictor 332 can be designed to deform at preselected pressures or ranges of pressures. Field conditions and design parameters can allow an operator to select a ball restrictor plate 328 with a certain rated pressure from a kit or assortment of plates, and relatively easily insert the plate on site between the upper valve housing 302 and the ball holder 322 shown in FIG. 5B. Because the plate can be inserted in either direction, operator errors can be reduced.

Figure 11A:
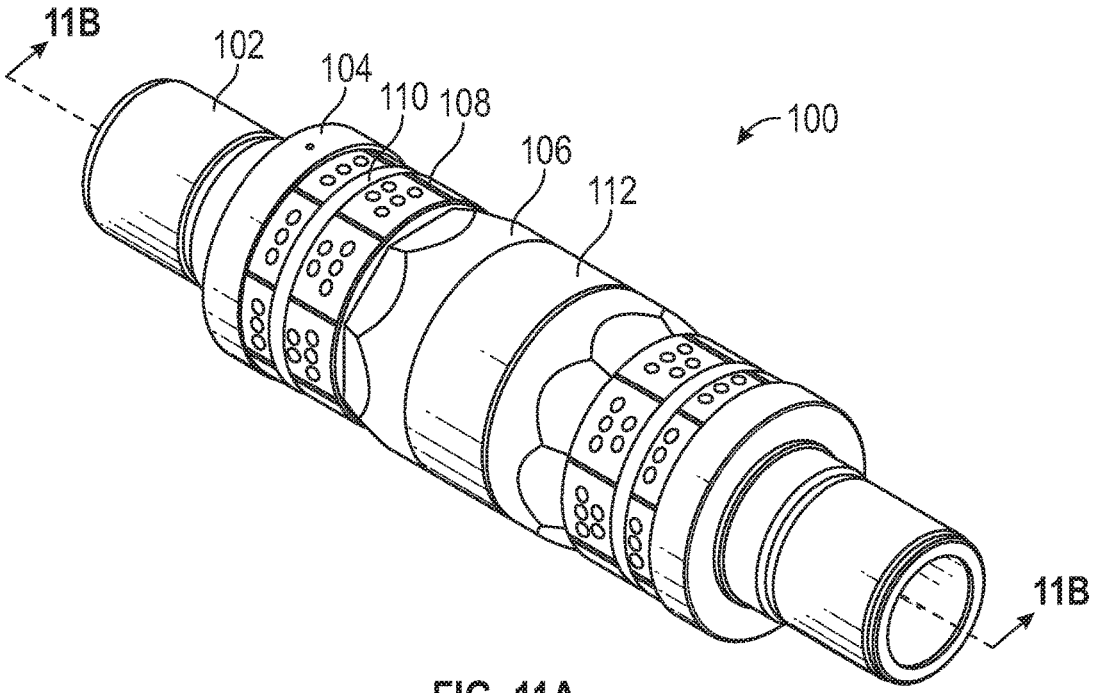
FIG. 11A is a schematic perspective view of the casing anchor and seal assembly (CAASA) of FIG. 1.
Figure 11B:
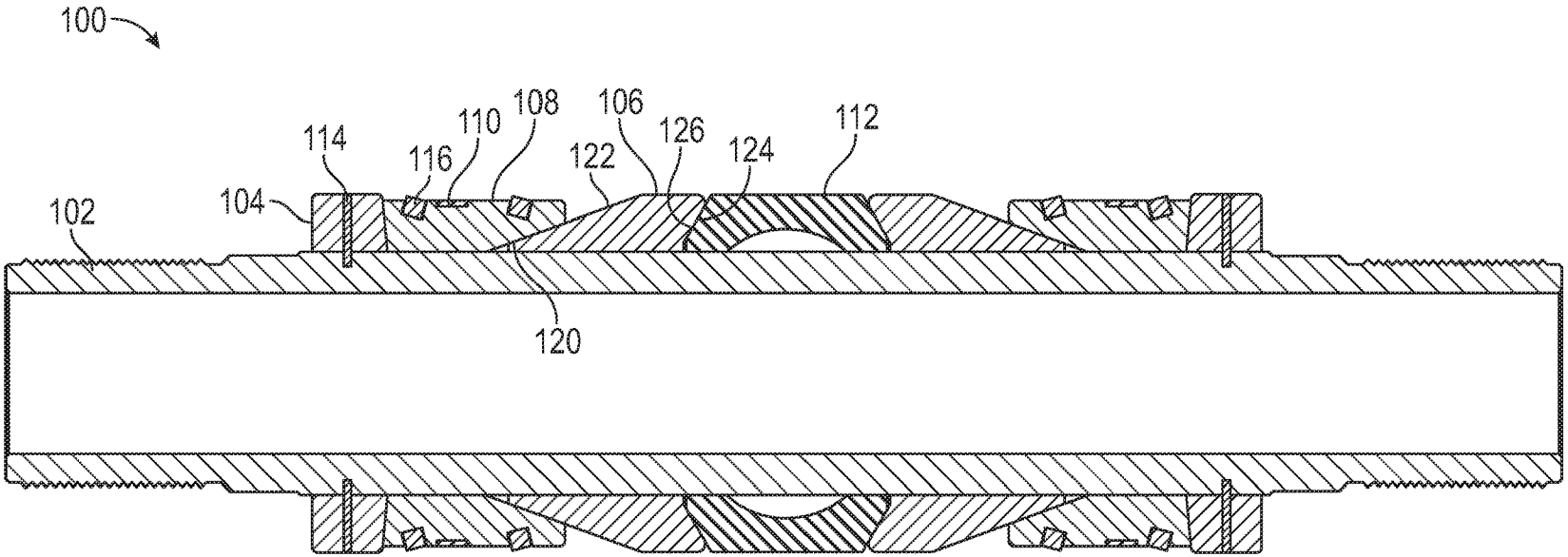
FIG. 11B is a schematic cross sectional view of the CAASA of FIG. 11A.
Figure 12A:
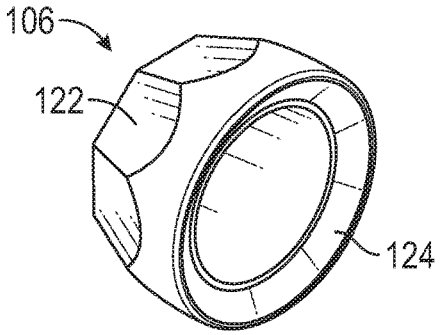
FIG. 12A is a schematic perspective view of a wedge for the CAASA.
Figure 12B:
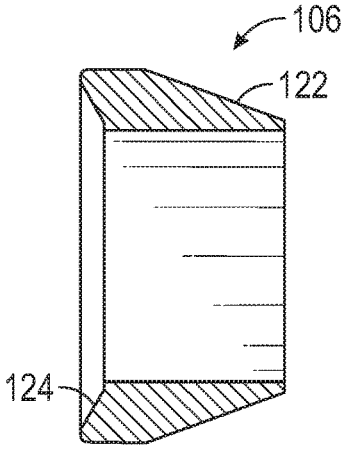
FIG. 12B is a schematic cross sectional view of the wedge of FIG. 12A.
Figure 12C:
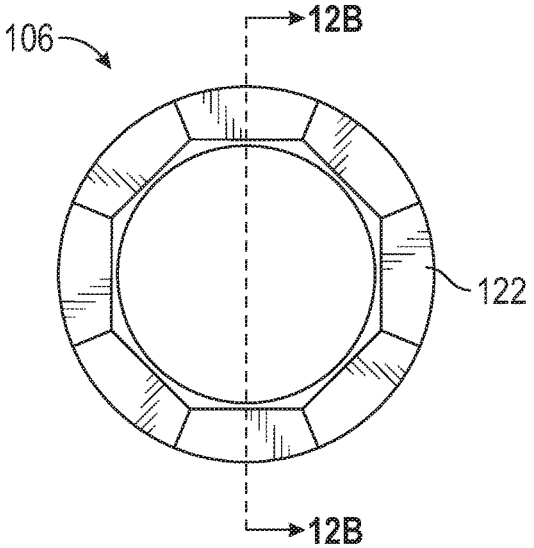
FIG. 12C is a schematic end view of the wedge of FIGS. 12A and 12B.
Figure 13A:
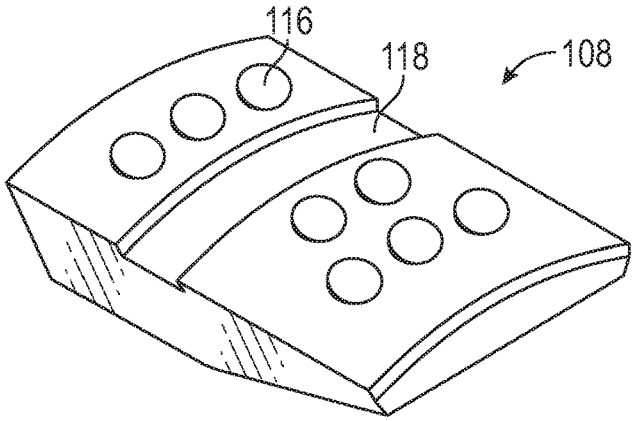
FIG. 13A is a schematic perspective view of a slip for the CAASA.
Figure 13B:
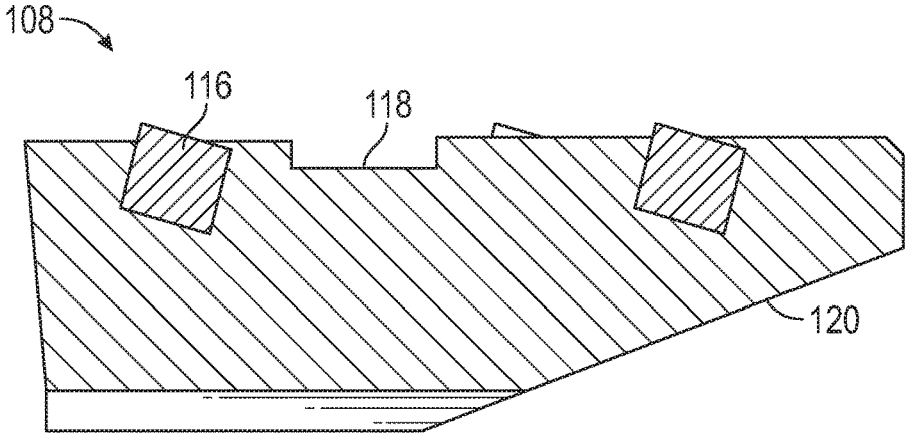
FIG. 13B is a schematic cross sectional view of the slip of FIG. 13A.
Figure 13C:
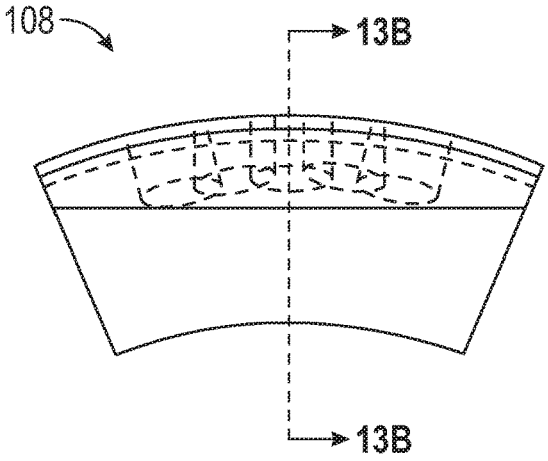
FIG. 13C is a schematic end view of the slip of FIGS. 13A and 13B.
Figure 14A:
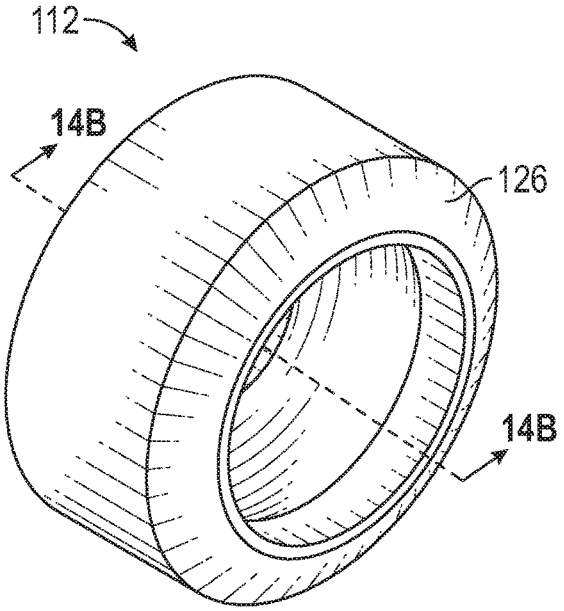
FIG. 14A is a schematic perspective view of a sealing element for the CAASA.
Figure 14B:
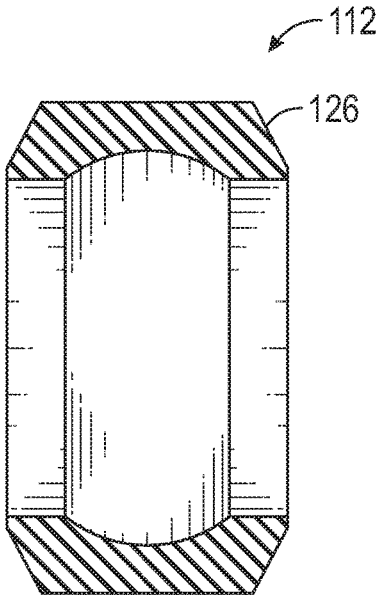
FIG. 14B is a schematic cross sectional view of the sealing element of FIG. 14A.

FIGS. 11A-14B illustrate an assembly and various components of an exemplary casing anchor and seal assembly (CAASA). FIG. 11A is a schematic perspective view of the exemplary CAASA shown in FIG. 1, FIG. 11B is a schematic cross sectional view of the CAASA of FIG. 11A. FIG. 12A is a schematic perspective view of a wedge for the CAASA. FIG. 12B is a schematic cross sectional view of the wedge of FIG. 12A. FIG. 12C is a schematic end view of the wedge of FIGS. 12A and 12B. FIG. 13A is a schematic perspective view of a slip for the CAASA. FIG. 13B is a schematic cross sectional view of the slip of FIG. 13A. FIG. 13C is a schematic end view of the slip of FIGS. 13A and 13B. FIG. 14A is a schematic perspective view of a sealing element for the CAASA. FIG. 14B is a schematic cross sectional view of the sealing element of FIG. 14A. As referenced in FIG. 1, a CAASA 100 can be coupled to each of the lower valve assembly 200 and the upper valve assembly 300.

The CAASA 100 includes a mandrel 102 with ends, generally pin ends. Each of the mandrel pin ends can be threaded for coupling with adjacent assemblies and components, and are interchangeable between the ends so that the orientation and actuation can occur from either end. This feature of interchangeable ends is advantageous due to the system having modular components. Additional components for the CAASA described below can be coupled to the outer periphery of the mandrel. Starting in the middle, a sealing element 112 can be used to seal the CAASA against a bore of a casing. By compressing axially, the sealing element expands radially. To compress axially, slidable wedges and slips are used generally for both sides of the sealing element. For example, a wedge 106 can be slid along the outer periphery of the mandrel to contact the sealing element 112. A wedge seal taper 124 can engage a correspondingly seal taper 126 to assist in guiding the longitudinal compression of the sealing element 112. Further, a slip 108 having a slip taper 120 can slidably engage the wedge 106 along a wedge slip taper 122. The slip 108 is formed from a plurality of slip elements (for example and without limitation 2-16 elements) that circumscribe the mandrel 102, where the slip elements are held together by a slip band 110. As the slip 108 moves longitudinally, the slip taper 120 travels along the wedge slip taper 122 that forces the slip to move radially outward (and expanding or breaking the band 110) toward the bore of the casing surrounding the CAASA. A plurality of gripping elements 116 (known as "buttons") can be coupled to the outer periphery of the slip elements and are generally angled to provide point or line contact with the bore of the casing upon engagement. Upon radial expansion of the slip 108, the gripping elements 116 can engage the bore of the casing to restrain further longitudinal movement of the slip and therefore the CAASA. A corresponding wedge and slip is provided on the distal side of the sealing element 112 in like fashion. The assembly of the sealing element, wedges, and slips are held in position by a pair of slip support rings 104, which can be temporarily held in longitudinal position to the mandrel 102 by one or more restraining elements 114 such as shear pins, screws such as set screws, adhesive applied to the relative components, and the like and can be removable. In at least one embodiment, one of the slip support rings can be restrained with a restraining element and the other slip support ring can be slidably coupled with the mandrel, so that upon activation of the CAASA, the slidable support ring is moved longitudinally to compress the sealing member while the other support ring can remain stationary for at least a period of time. In this example, other components, such as a shoe, can be coupled with the CAASA to support the fixed support ring from moving.

Figure 15A:
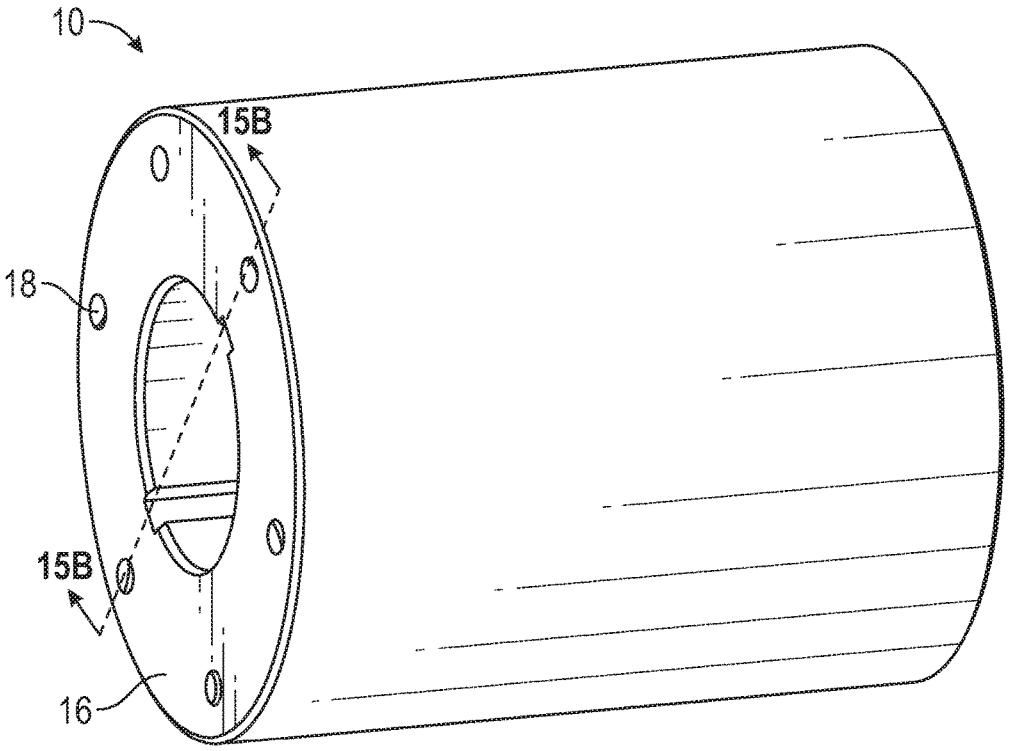
FIG. 15A is a schematic perspective view of a top shoe for the CAASA.

FIG. 15A is a schematic perspective view of a top shoe for the CAASA.

Figure 15B:
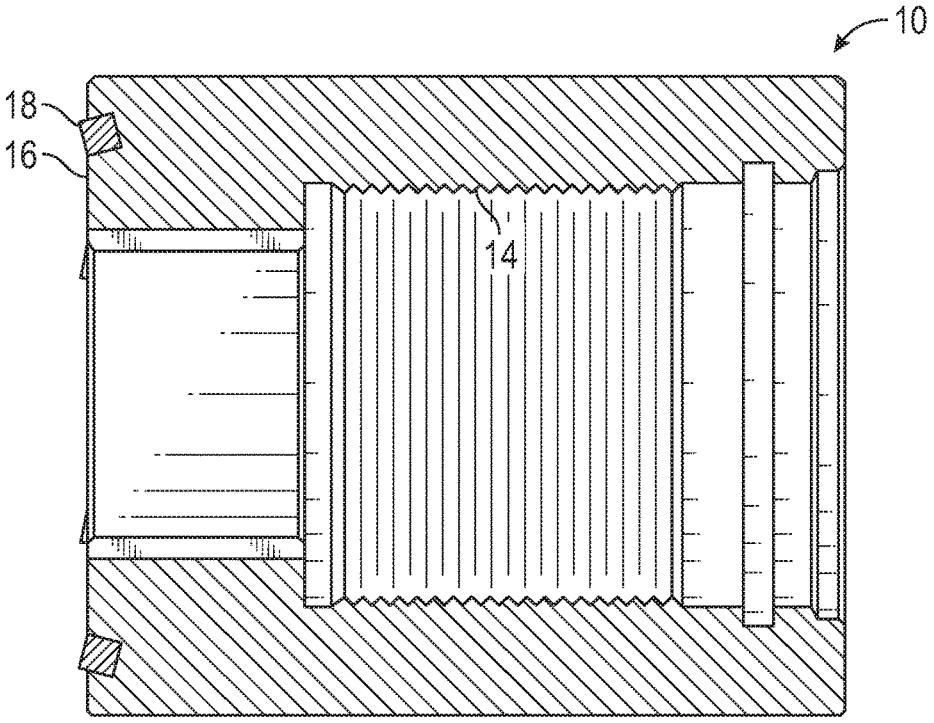
FIG. 15B is a schematic cross sectional view of the top shoe of FIG. 15A.
Figure 15C:
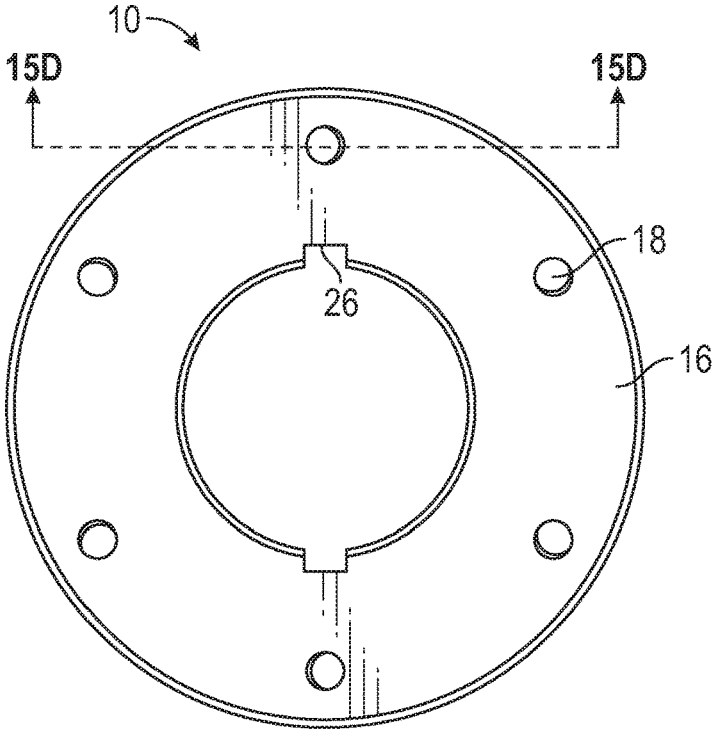
FIG. 15C is a schematic end view of the top shoe of FIG. 15A.
Figure 15D:
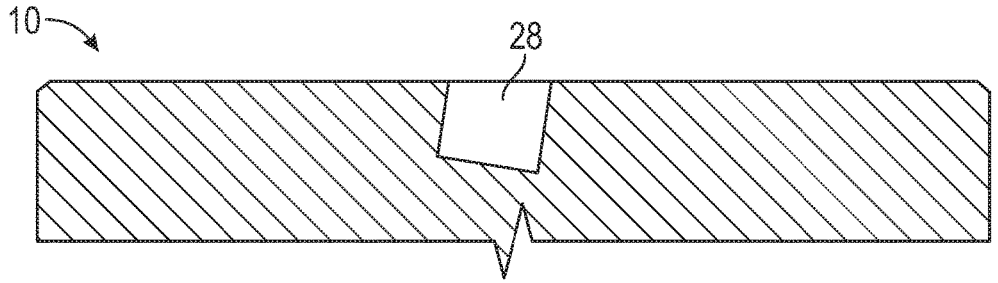
FIG. 15D is a schematic partial cross sectional view of a portion of the top shoe shown in FIG. 15C with an opening for gripping elements.

FIG. 15B is a schematic cross sectional view of the top shoe of FIG. 15A. FIG. 15C is a schematic end view of the top shoe of FIG. 15A. FIG. 15D is a schematic partial cross sectional view of a portion of the top shoe shown in FIG. 15C with an opening for gripping elements. A top shoe 10 is provided for engagement with the CAASA 100 that is attached to the upper valve assembly 300, as shown in FIG. 1 for the assembly. The top shoe 10 includes a threaded bore 14 sized to engage the corresponding threaded pin end on the upper CAASA, A top end 16 of the top shoe can include one or more gripping elements 18 that can be inserted in openings 28, shown in FIG. 15D. The openings 28 can be angled to provide a line or point contact of the gripping elements to resist slippage of rotating components that may engage the top end 16 of the top shoe 10. The gripping elements can assist in providing a nonslip surface for drilling out the float system after completion of cementing operations. One or more key slots 26 are formed in a bore of the top shoe to assist in rotating the top shoe during installation to the CAASA, as described herein.

Figure 16A:
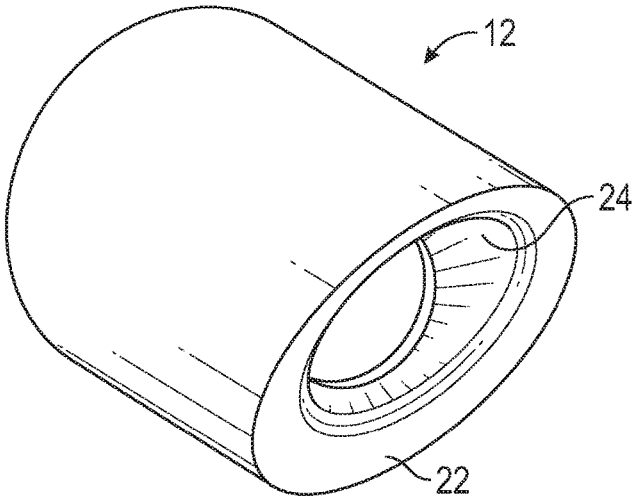
FIG. 16A is a schematic perspective view of a bottom shoe for the CAASA.
Figure 16B:
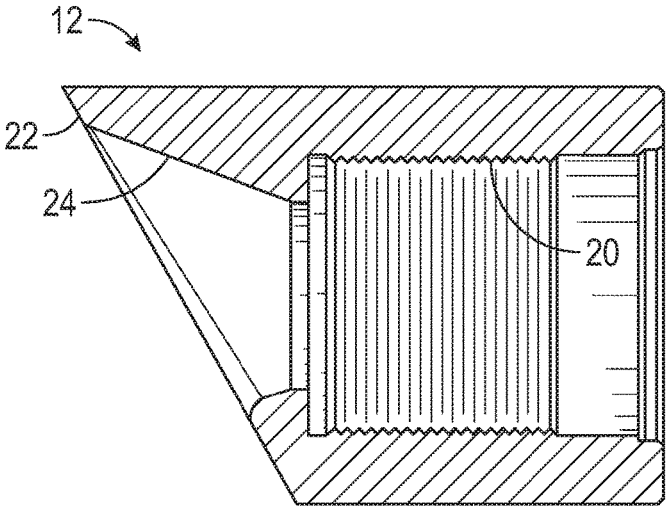
FIG. 16B is a schematic cross sectional view of the bottom shoe of FIG. 16A.
Figure 16C:
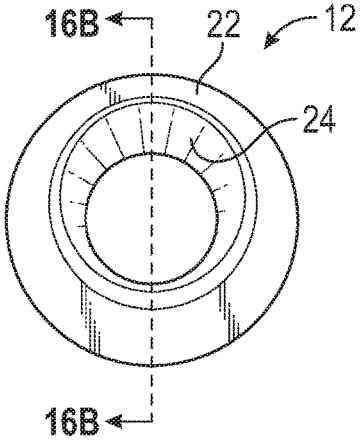

FIG. 16A is a schematic perspective view of a bottom shoe for the CAASA, FIG. 16B is a schematic cross sectional view of the bottom shoe of FIG. 16A. FIG. 16C is a schematic end view of the bottom shoe of FIGS. 16A and 16B. A bottom shoe 12 is provided for engagement with the CAASA 100 that is attached to the lower valve assembly 200, as shown in FIG. 1 for the assembly. The bottom shoe 12 includes a threaded bore 20 sized to engage the corresponding threaded pin end on the lower CAASA. The bottom shoe 12 further includes a lead angle 22 that can correspond to the lead angle 362, described above for the upper valve assembly shoe 320 in FIGS. 7A-7B. As the float system is drilled out after completion of cementing operations, the upper valve assembly is drilled out first and has various components below the slips that become loose and travel down the casing until the lower valve assembly is reached. The remaining upper valve system components with the lead taper 362, shown in FIGS. 5A-5B, can engage the bottom shoe with the lead taper 22 that resists rotation while such portions are drilled further out.

Figure 17A:
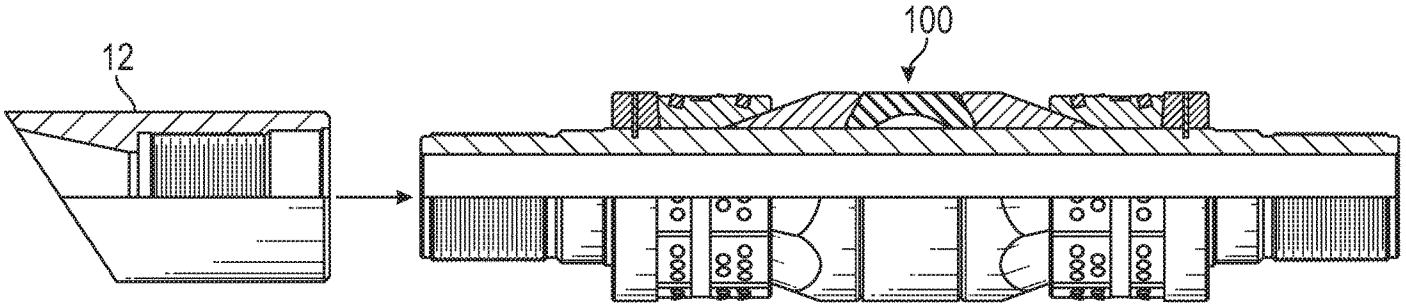
FIG. 17A is a schematic partial cross sectional view of a lower CAASA and the bottom shoe ready for coupling with the CAASA.

FIGS. 17A-17M illustrate an exemplary assembly method for the lower assembly 4 described above. FIG. 17A is a schematic partial cross sectional view of a lower CAASA and the bottom shoe ready for coupling with the CAASA. For installation, adhesive can be applied to internal threads on the bore of the bottom shoe 12.

Figure 17B:
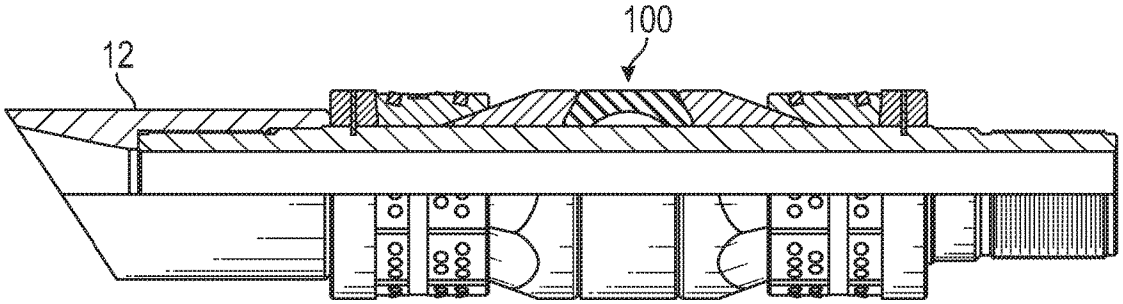
FIG. 17B is a schematic partial cross sectional view of the CAASA coupled with the bottom shoe.

FIG. 17B is a schematic partial cross sectional view of the CAASA coupled with the bottom shoe. The bottom shoe 12 can be threaded onto the CAASA and tightened to a predetermined torque.

Figure 17C:
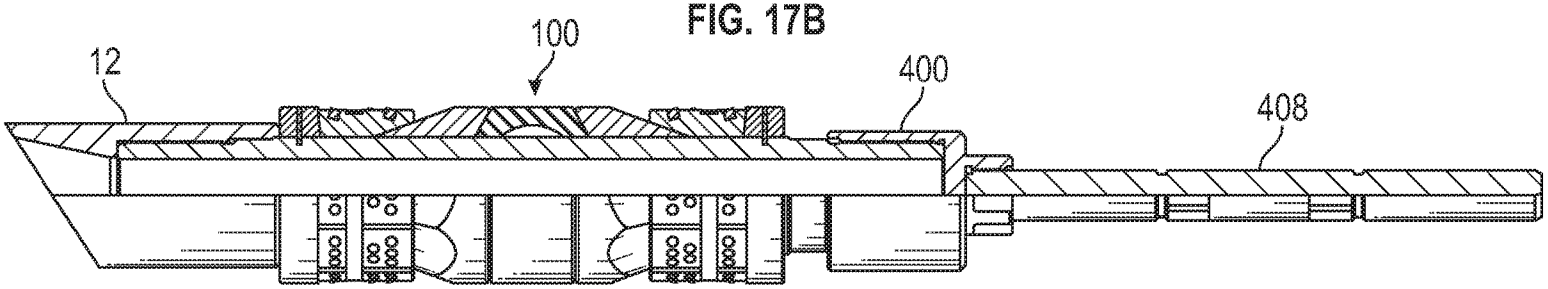
FIG. 17C is a schematic partial cross sectional view of the CAASA and bottom shoe with a setting tool coupled to the CAASA.
Figure 19A:
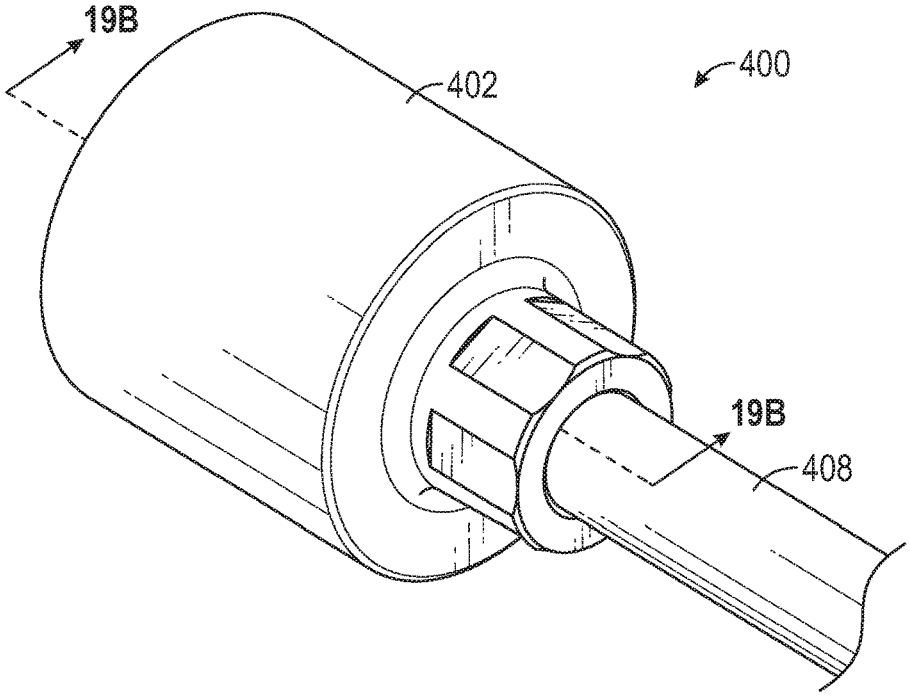
FIG. 19A is a schematic perspective view of an exemplary setting tool mandrel connector.
Figure 19B:
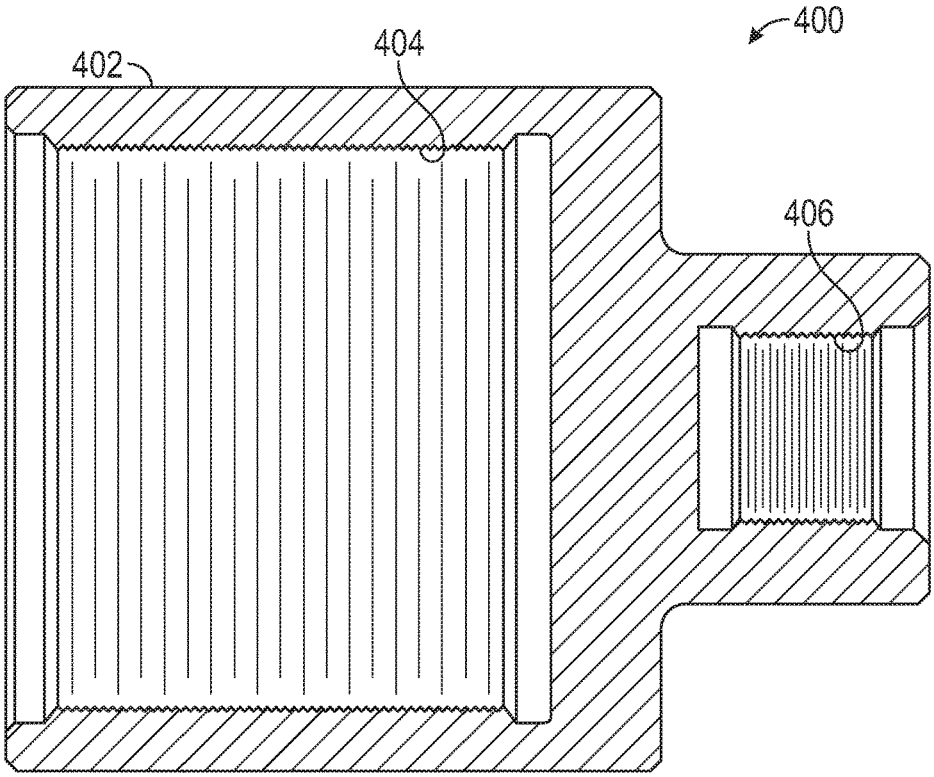
FIG. 19B is a schematic cross sectional view of the setting tool mandrel connector of FIG. 19A.

FIG. 17C is a schematic partial cross sectional view of the CAASA and bottom shoe with a setting tool coupled to the CAASA. An exemplary setting tool 400 is illustrated in FIGS. 19A-19B and described herein. The CAASA 100 can be coupled to the setting tool 400 with a tension mandrel 408 by threading the tool onto the CAASA at a distal end from the bottom shoe 12. Generally, it is not necessary to torque this connection, although the thread should be made up completely between the setting tool and the CAASA for sufficient gripping during the setting procedure.

Figure 17D:
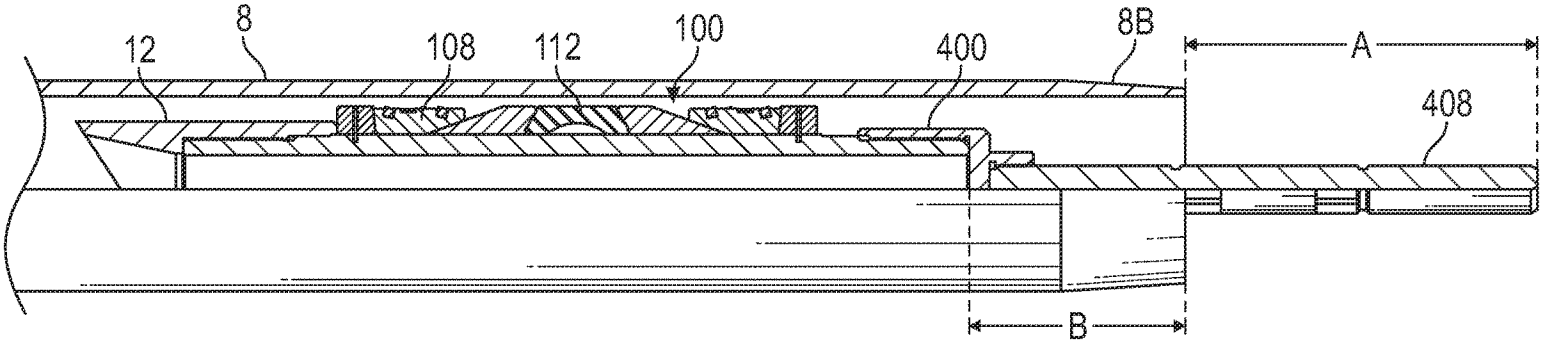
FIG. 17D is a schematic partial cross sectional view of the CAASA, bottom shoe, and setting tool inserted into a casing at the pin end.

FIG. 17D is a schematic partial cross sectional view of the CAASA, bottom shoe, and setting tool inserted into a casing at the pin end. The components can be inserted into the casing 8 with the tension mandrel 408, generally at the pin end 8B, at a predetermined distance "B" by measuring length "A" of the tension mandrel extending outside of the casing. The slips 108 and sealing element 112 of the CAASA 100 generally have radial clearance from the bore of the casing 8 to allow insertion therein.

Figure 17E:
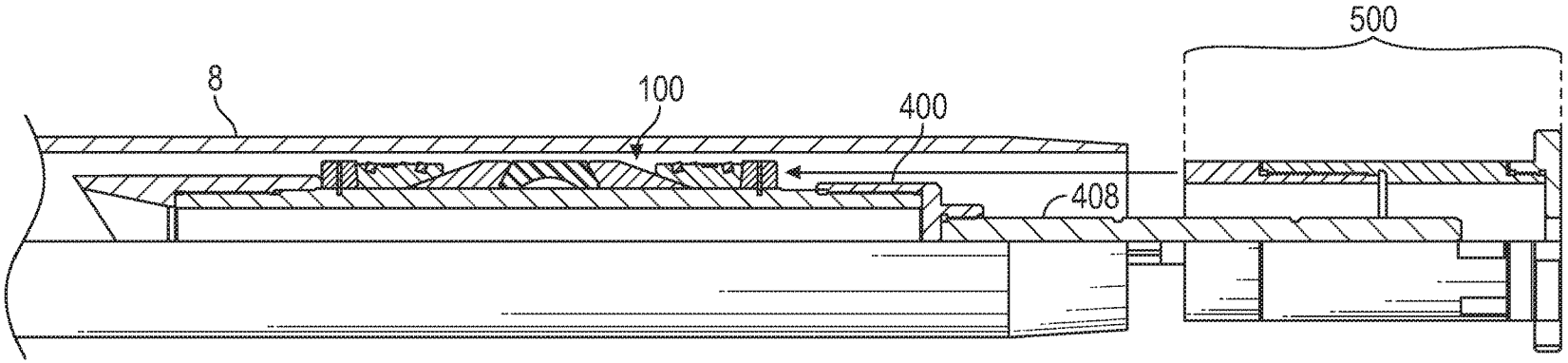
FIG. 17E is a schematic partial cross sectional view of the CAASA, bottom shoe, and setting tool with a setting sleeve assembly ready for insertion into the casing.

FIG. 17E is a schematic partial cross sectional view of the one or CAASA, bottom shoe, and setting tool with a setting sleeve assembly ready for insertion into the casing. A setting sleeve assembly 500 can be inserted into the casing at the pin end and over the protruding tension mandrel 408.

Figure 17F:
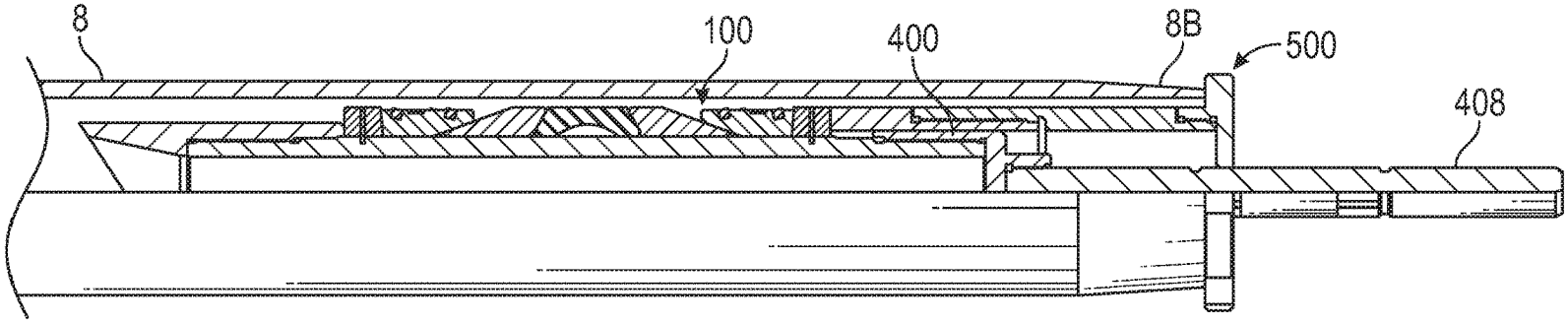
FIG. 17F is a schematic partial cross sectional view of the CAASA, bottom shoe, and setting tool with the setting sleeve assembly inserted into the casing and abutting the end of the casing.

FIG. 17F is a schematic partial cross sectional view of the CAASA, bottom shoe, and setting tool with the setting sleeve assembly inserted into the casing and abutting the end of the casing. The setting sleeve assembly 500 can be inserted fully into the casing until an outer hub of the setting sleeve assembly abuts the casing pin end 8B.

Figure 17G:
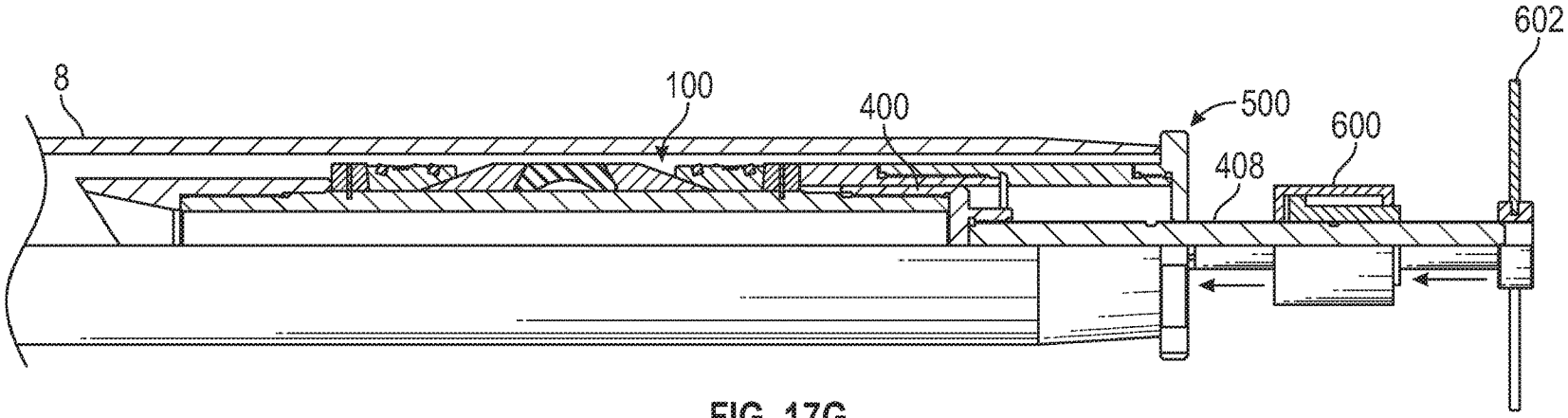
FIG. 17G is a schematic partial cross sectional view of the CAASA, bottom shoe, setting tool, and setting sleeve assembly with a jack coupled to the setting tool tension mandrel.

FIG. 17G is a schematic partial cross sectional view of the CAASA, bottom shoe, setting tool, and setting sleeve assembly with a jack coupled to the setting tool tension mandrel. A jack 600, generally a hydraulic jack, can be installed over the tension mandrel 408. The jack 600 can include a handle 602 threaded onto the tension mandrel for initial tightening.

Figure 17H:
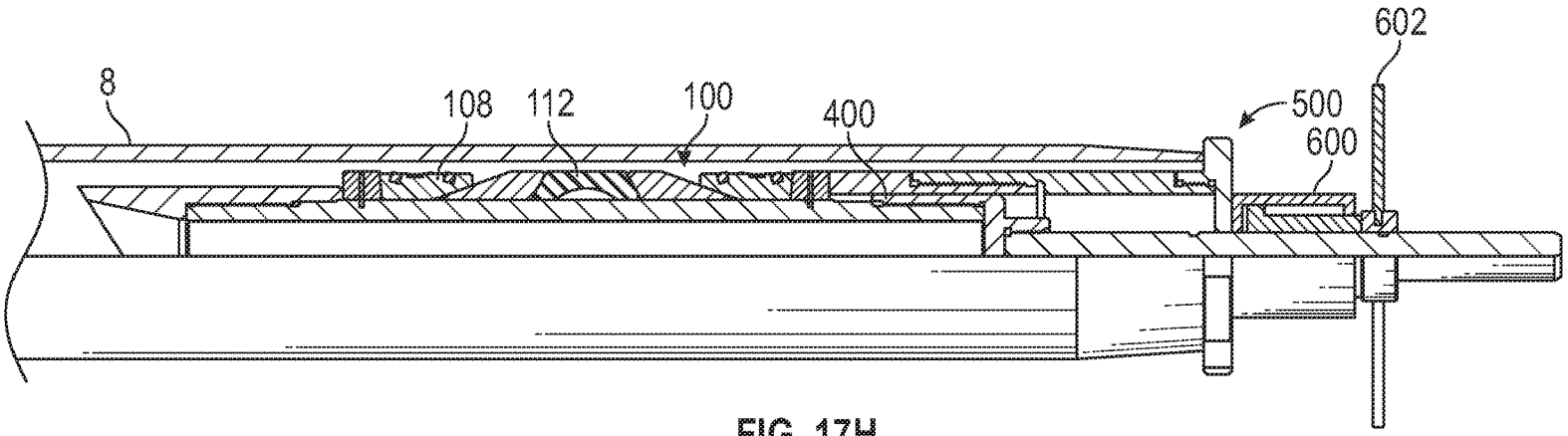
FIG. 17H is a schematic partial cross sectional view of the CAASA, bottom shoe, setting tool, and setting sleeve assembly with the jack initially tensioned on the setting tool tension mandrel.

FIG. 17H is a schematic partial cross sectional view of the CAASA, bottom shoe, setting tool, and setting sleeve assembly with the jack initially tensioned on the setting tool tension mandrel. The handle 602 can be rotated for initial tightening of the CAASA 100 to the bore of the casing 8 until torque increases noticeably as the slips 108 of the CAASA expand radially outward and make contact with the casing bore. The jack 600 can press against the setting sleeve assembly 500.

Figure 17I:
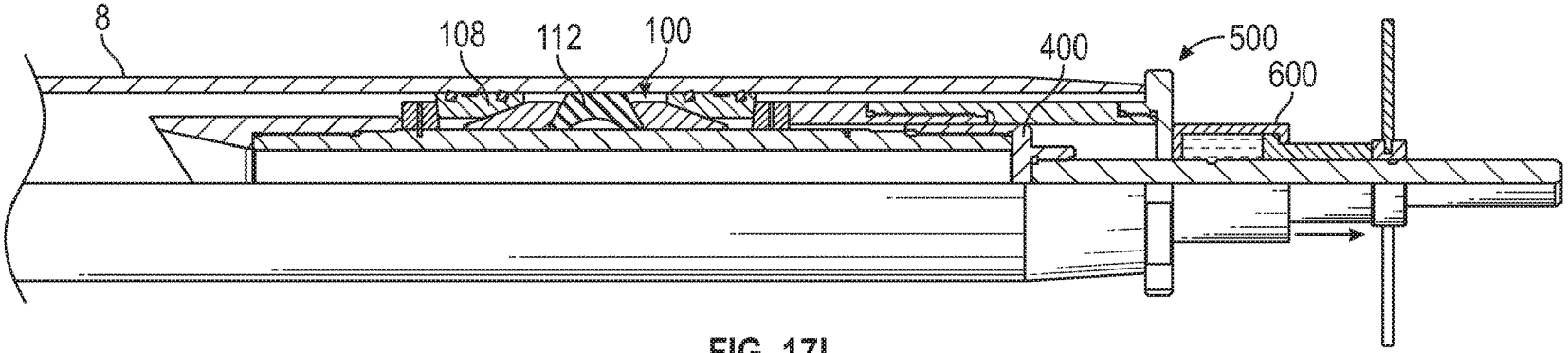
FIG. 17I is a schematic partial cross sectional view of the CAASA, bottom shoe, setting tool, and setting sleeve assembly with the jack activated to set the CAASA to the casing bore.

FIG. 17I is a schematic partial cross sectional view of the CAASA, bottom shoe, setting tool, and setting sleeve assembly with the jack activated to set the CAASA to the casing bore. The jack 600 can be activated, such as by hydraulic pressure, to pull the tension mandrel thereby forcing the slips 108 and sealing element 112 radially outward as the components longitudinally contact the setting sleeve assembly 500. The slips 108 grip onto the bore of the casing 8 and the sealing element 112 forms a seal with the casing bore. When sufficient force has been created by the jack on the slips 108 and sealing element 112, the jack 600 can be held at a given pressure for a period of time, and then any hydraulic pressure released from the jack, so that the jack is deactivated.

Figure 17J:
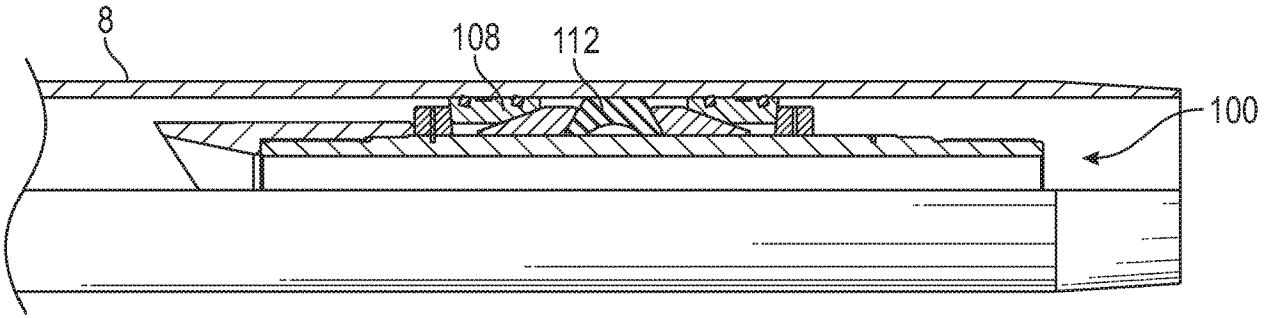
FIG. 17J is a schematic partial cross sectional view of the CAASA and bottom shoe with the setting tool, setting sleeve assembly, and jack removed.

FIG. 17J is a schematic partial cross sectional view of the CAASA and bottom shoe with the setting tool, setting sleeve assembly, and jack removed. Disassembly of the installation components can be in reverse order of assembly, including unthreading the setting tool 400 from the CAASA 100.

Figure 17K:
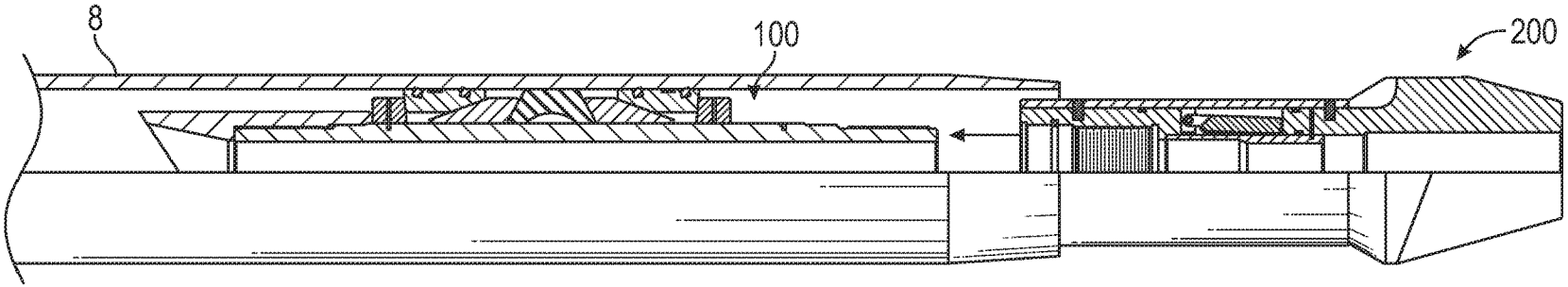
FIG. 17K is a schematic partial cross sectional view of the CAASA and bottom shoe with a lower valve assembly.

FIG. 17K is a schematic partial cross sectional view of the CAASA and bottom shoe with a lower valve assembly. Adhesive can be applied to the bore of the lower valve assembly 200 and one or more O-rings installed to the lower valve assembly. The lower valve assembly 200 can be partially inserted into the casing and is ready for coupling with the CAASA distal from the bottom shoe.

Figure 17L:
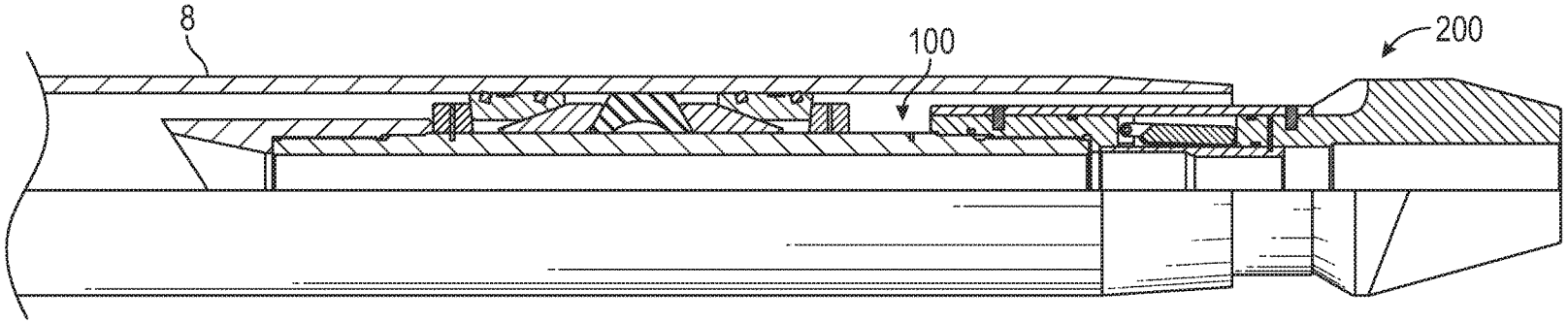
FIG. 17L is a schematic partial cross sectional view of the CAASA and bottom shoe with the lower valve assembly coupled to the CAASA.

FIG. 17L is a schematic partial cross sectional view of the CAASA and bottom shoe with the lower valve assembly coupled to the CAASA. The lower valve assembly 200 can be threaded onto the CAASA 100 and torqued to a predetermined value.

Figure 17M:
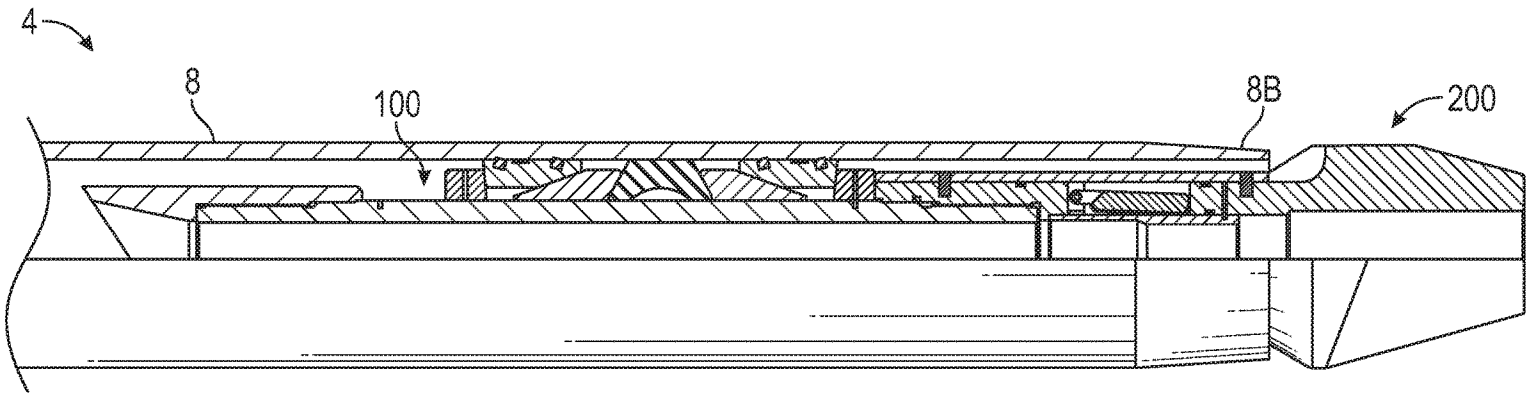
FIG. 17M is a schematic partial cross sectional view of the CAASA, bottom shoe, and lower valve assembly inserted a further distance into the casing.

FIG. 17M is a schematic partial cross sectional view of the CAASA, bottom shoe, and lower valve assembly inserted a further distance into the casing. The lower end of the lower valve assembly 200 can be tapped to seat against the casing pin end 8B. The lower assembly 4 is now installed in the casing 8.

Figure 18A:
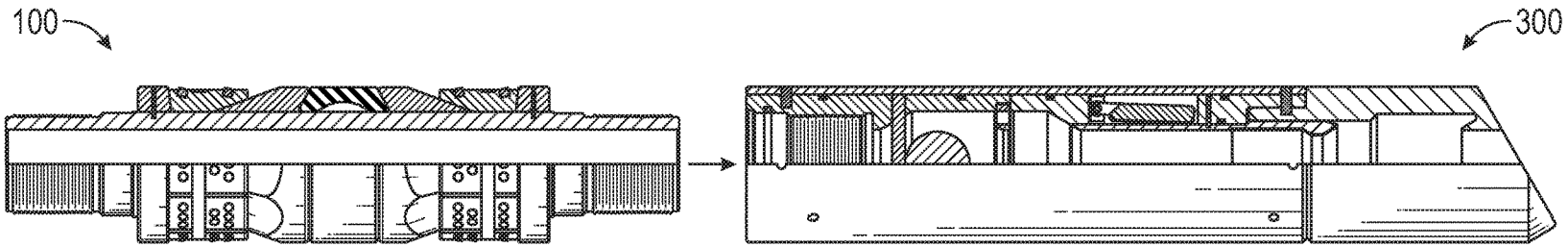
FIG. 18A is a schematic partial cross sectional view of an upper CAASA and an upper valve assembly ready for coupling with the CAASA.

FIGS. 18A-18M illustrate an exemplary assembly method for the upper assembly 6 described above. FIG. 18A is a schematic partial cross sectional view of an upper CAASA and an upper valve assembly ready for coupling with the CAASA. Adhesive can be applied to the bore of the upper valve assembly 300 and one or more O-rings installed to the upper valve assembly.

Figure 18B:
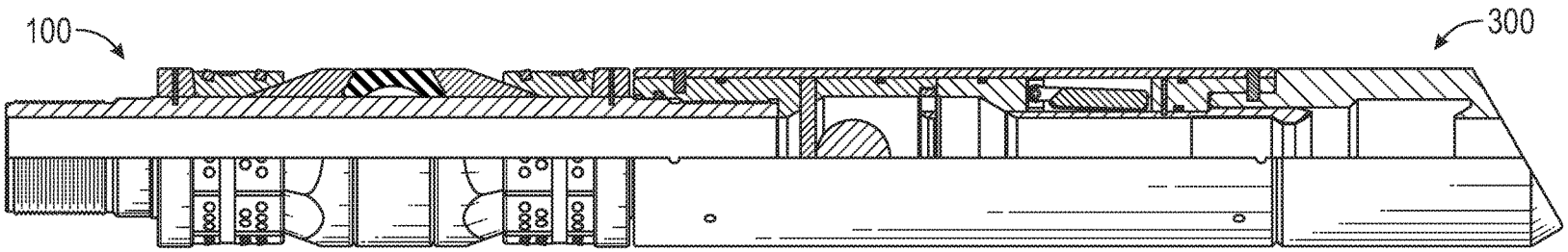
FIG. 18B is a schematic partial cross sectional view of the CAASA coupled with the upper valve assembly.

FIG. 18B is a schematic partial cross sectional view of the CAASA coupled with the upper valve assembly. The upper valve assembly 200 can be threaded onto the CAASA 100 and torqued to a predetermined value.

Figure 18C:
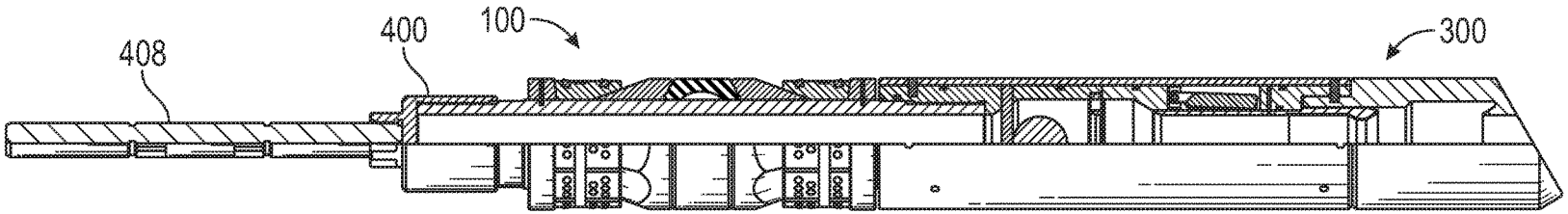
FIG. 18C is a schematic partial cross sectional view of the CAASA and upper valve assembly with a setting tool coupled to the CAASA.

FIG. 18C is a schematic partial cross sectional view of the CAASA and upper valve assembly with a setting tool coupled to the CAASA. The CAASA 100 can be coupled with a setting tool 400 with a tension mandrel 408 by threading the tool onto the CAASA at a distal end from the upper valve assembly 300. Generally, it is not necessary to torque this connection, although the thread should be made up completely between the setting tool and the CAASA for sufficient gripping during the setting procedure.

Figure 18D:
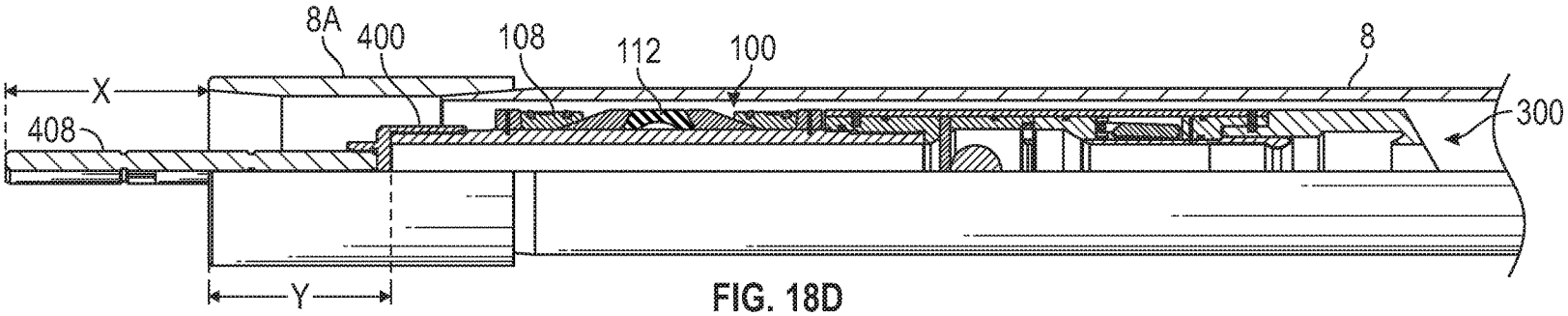
FIG. 18D is a schematic partial cross sectional view of the CAASA, upper valve assembly, and setting tool inserted into a casing at the collar end.

FIG. 18D is a schematic partial cross sectional view of the CAASA, upper valve assembly, and setting tool inserted into a casing at the collar end. The components can be inserted into the casing 8 with the tension mandrel 408, generally at the coupling end 8A of the casing 8, at a predetermined distance "Y" by measuring length "X" of the tension mandrel extending outside of the casing. The slips 108 and sealing element 112 of the CAASA 100 generally have clearance from the bore of the casing 8 to allow insertion therein.

Figure 18E:
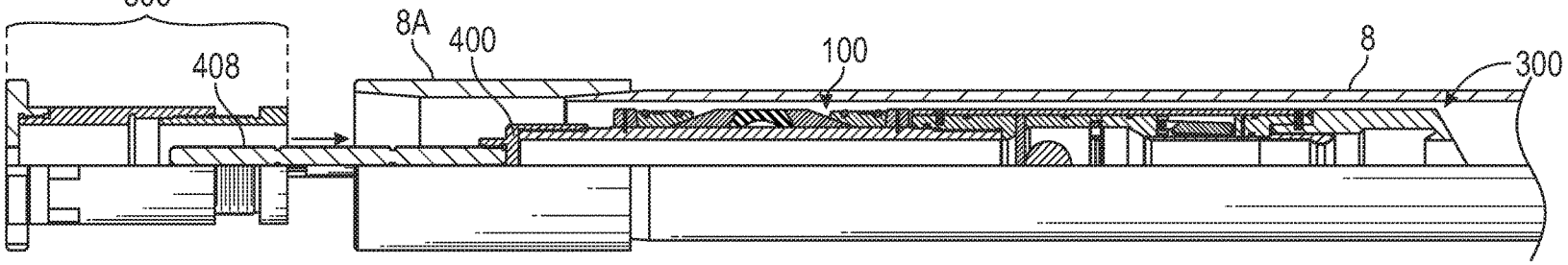
FIG. 18E is a schematic partial cross sectional view of the CAASA, upper valve assembly, and setting tool with a setting sleeve assembly ready for insertion into the casing at the collar end.

FIG. 18E is a schematic partial cross sectional view of the CAASA, upper valve assembly, and setting tool with a setting sleeve assembly ready for insertion into the casing at the collar end. A setting sleeve assembly 500 can be inserted into the casing at the coupling end and over the protruding tension mandrel 408.

Figure 18F:
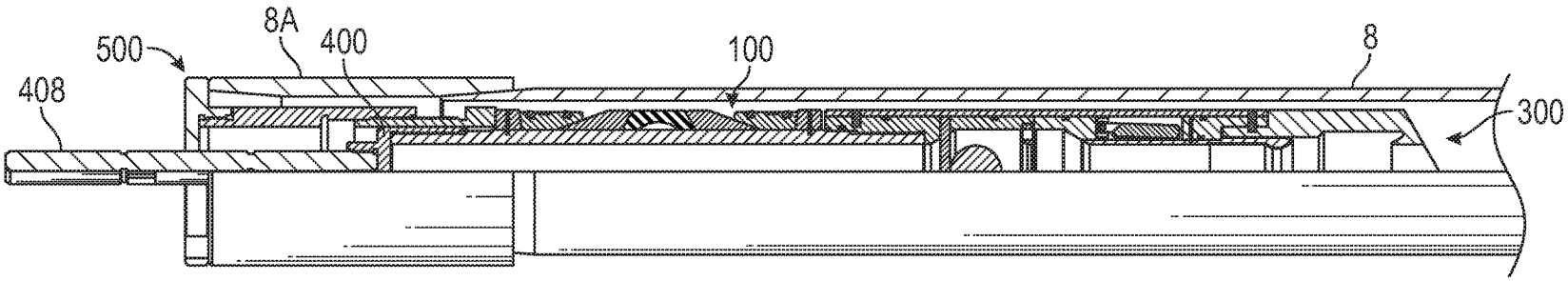
FIG. 18F is a schematic partial cross sectional view of the CAASA, upper valve assembly, and setting tool with the setting sleeve assembly inserted into the casing and abutting the collar end.

FIG. 18F is a schematic partial cross sectional view of the CAASA, upper valve assembly, and setting tool with the setting sleeve assembly inserted into the casing and abutting the collar end. The setting sleeve assembly 500 can be inserted fully into the casing until the outer hub of the setting sleeve assembly abuts the casing coupling end 8A.

Figure 18G:
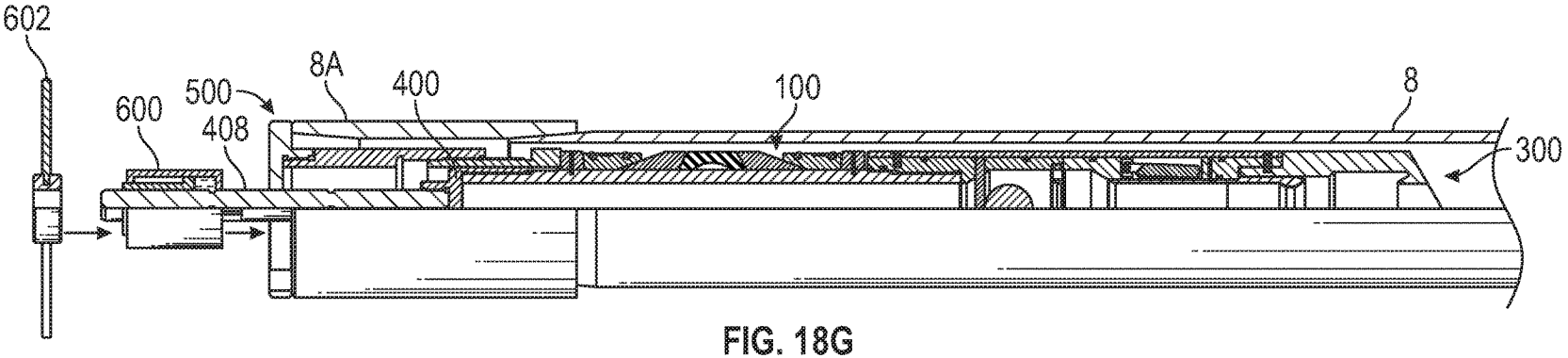
FIG. 18G is a schematic partial cross sectional view of the CAASA, upper valve assembly, setting tool, and setting sleeve assembly with a jack coupled to the setting tool tension mandrel.

FIG. 18G is a schematic partial cross sectional view of the CAASA, upper valve assembly, setting tool, and setting sleeve assembly with a jack coupled to the setting tool tension mandrel. A jack 600, generally a hydraulic jack, can be installed over the tension mandrel 408. The jack 600 can include a handle 602 threaded onto the tension mandrel for initial tightening.

Figure 18H:
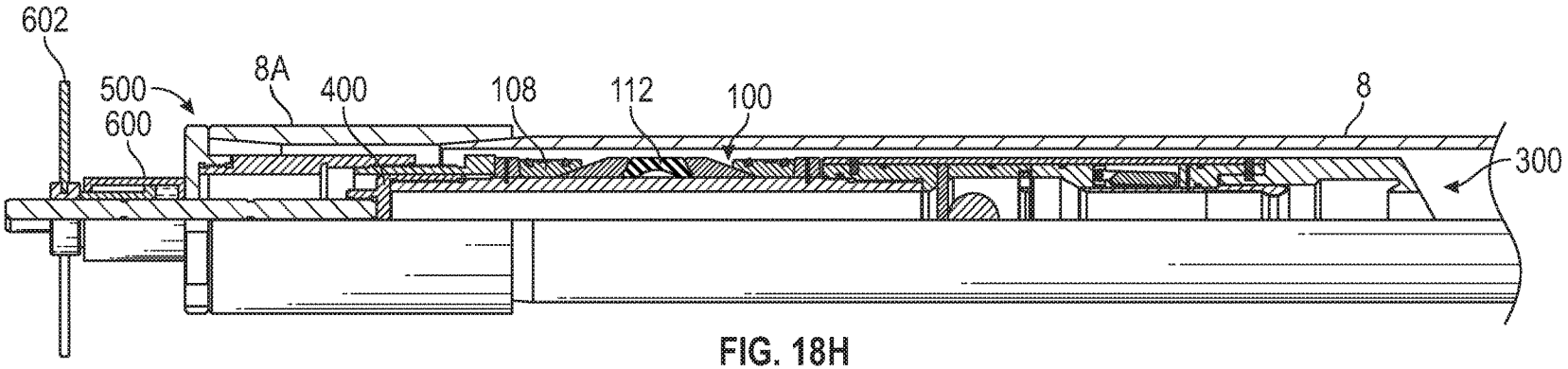
FIG. 18H is a schematic partial cross sectional view of the CAASA, upper valve assembly, setting tool, and setting sleeve assembly with the jack initially tensioned on the setting tool tension mandrel.

FIG. 18H is a schematic partial cross sectional view of the CAASA, upper valve assembly, setting tool, and setting sleeve assembly with the jack initially tensioned on the setting tool tension mandrel. The handle 602 can be rotated for initial tightening of the CAASA 100 to the bore of the casing 8 until torque increases noticeably as the slips 108 of the CAASA expand radially outward and make contact with the casing bore. The jack 600 can press against the setting sleeve assembly 500.

Figure 18I:
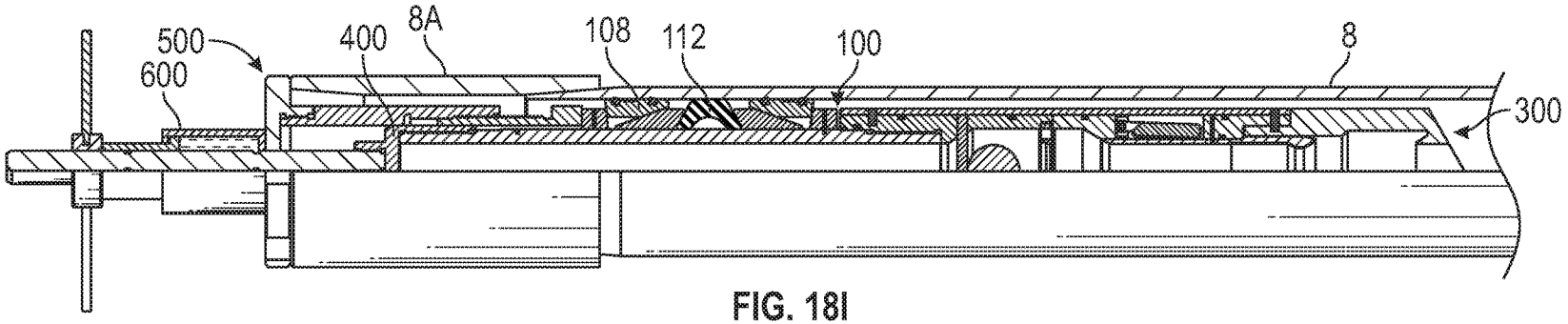
FIG. 18I is a schematic partial cross sectional view of the CAASA, upper valve assembly, setting tool, and setting sleeve assembly with the jack activated to set the CAASA to the casing bore.

FIG. 18I is a schematic partial cross sectional view of the CAASA, upper valve assembly, setting tool, and setting sleeve assembly with the jack activated to set the CAASA to the casing bore. The jack 600 can be activated, such as by hydraulic pressure, to pull the tension mandrel thereby forcing the slips 108 and sealing element 112 radially outward as the components longitudinally contact the setting sleeve assembly 500. The slips 108 grip onto the bore of the casing 8 and the sealing element 112 forms a seal with the casing bore. When sufficient force has been created by the jack on the slips 108 and sealing element 112, the jack 600 can be held at a given pressure for a period of time, and then any hydraulic pressure released from the jack, so that the jack is deactivated.

Figure 18J:
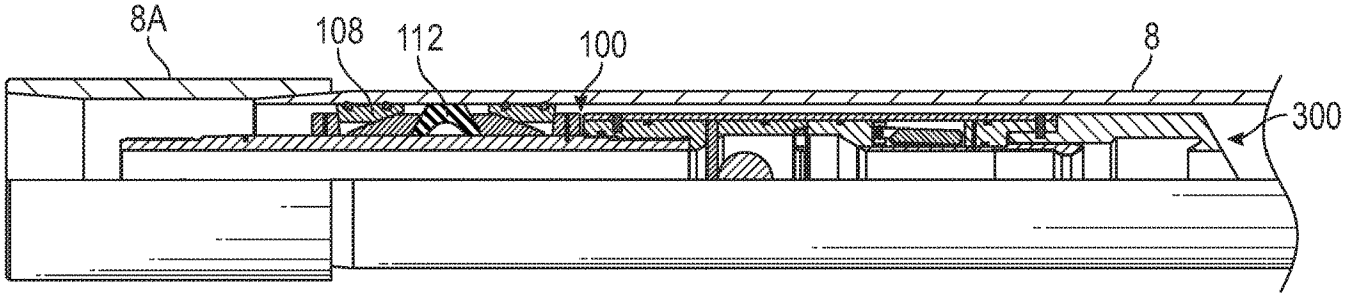
FIG. 18J is a schematic partial cross sectional view of the CAASA and upper valve assembly with the setting tool, setting sleeve assembly, and jack removed.

FIG. 18J is a schematic partial cross sectional view of the CAASA and upper valve assembly with the setting tool, setting sleeve assembly, and jack removed. Disassembly of the installation components can be in reverse order of assembly including unthreading the setting tool 400 from the CAASA 100.

Figure 18K:
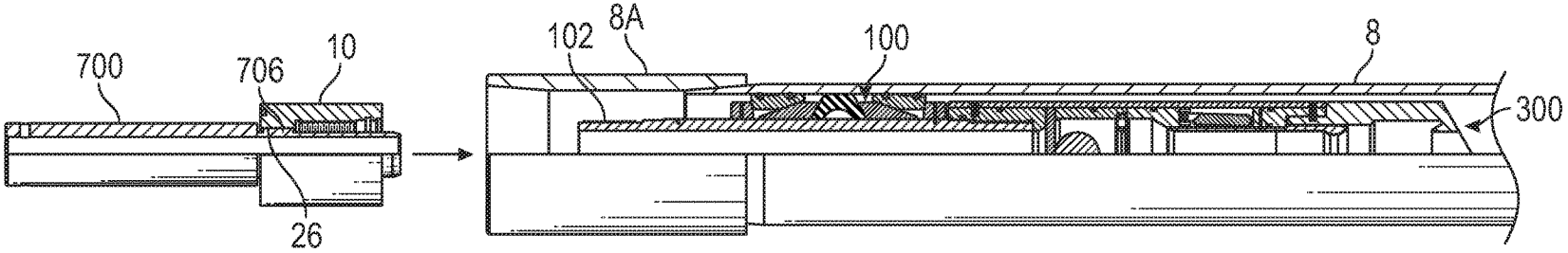
FIG. 18K is a schematic partial cross sectional view of the CAASA and upper valve assembly with a top shoe installation fixture coupled to a top shoe ready for coupling with the CAASA distal from the upper valve assembly.
Figure 20A:
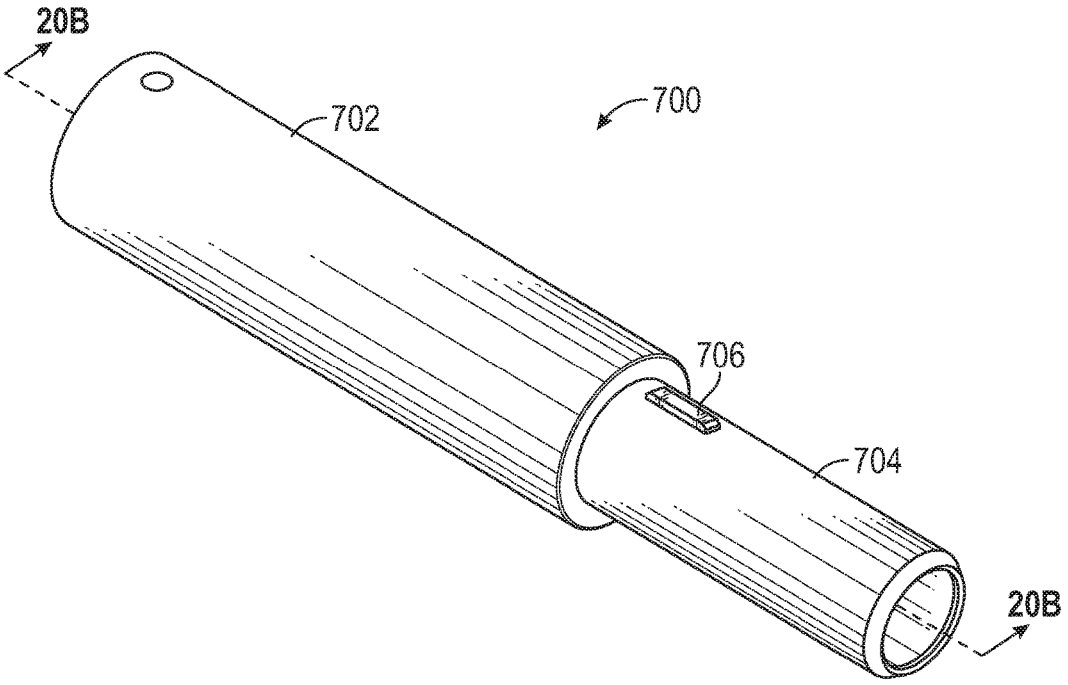
FIG. 20A is a schematic perspective view of an exemplary shoe installation fixture.
Figure 20B:
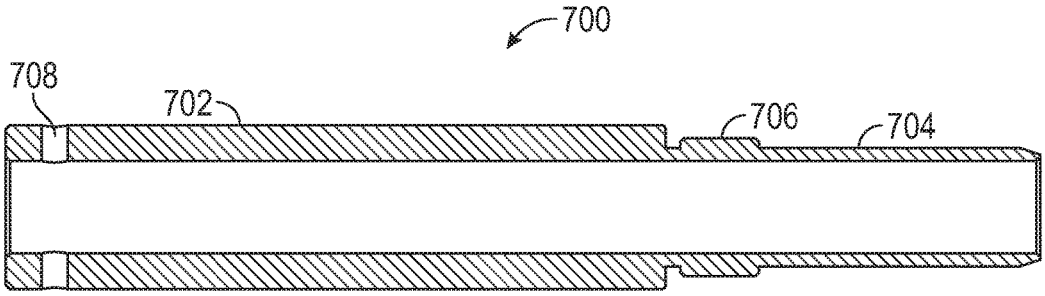
FIG. 20B is a schematic cross sectional view of the shoe installation fixture of FIG. 20A.

FIG. 18K is a schematic partial cross sectional view of the CAASA and upper valve assembly with a top shoe installation fixture coupled to a top shoe ready for coupling with the CAASA distal from the upper valve assembly. An exemplary top shoe installation fixture 700 is illustrated in FIGS. 20A-20B and described herein. Adhesive can be applied to the bore of the top shoe 10 and one or more O-rings installed to the top shoe. The top shoe 10 can be partially inserted into the casing with the key slots 26 of the top shoe engaged with corresponding keys 706 in the installation fixture, and is ready for coupling with the CAASA distally from the upper valve assembly 300.

Figure 18L:
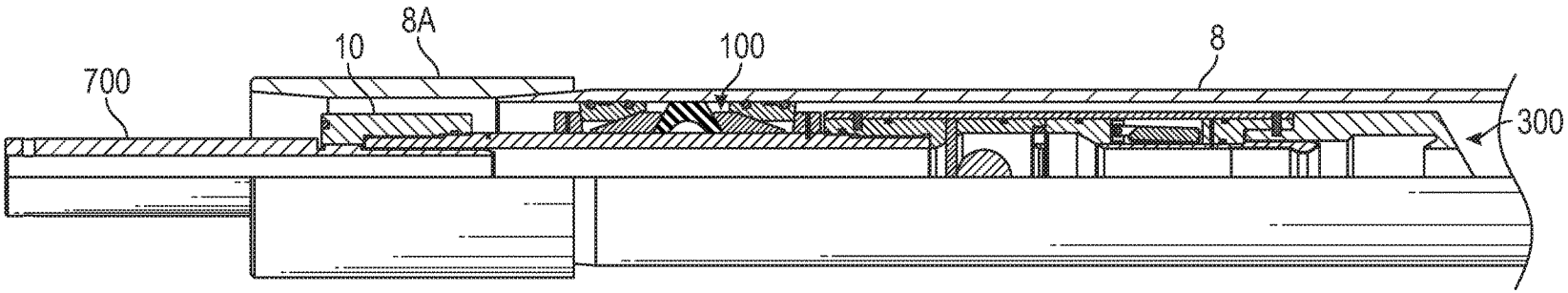
FIG. 18L is a schematic partial cross sectional view of the CAASA and upper valve assembly with the shoe installation fixture coupling the top shoe with the CAASA.

FIG. 18L is a schematic partial cross sectional view of the CAASA and upper valve assembly with the shoe installation fixture coupling the top shoe with the CAASA. The top shoe 10 can be threaded onto the CAASA 100 by rotating the installation fixture that is keyed with the top shoe. The top shoe can be torqued to a predetermined value.

Figure 18M:
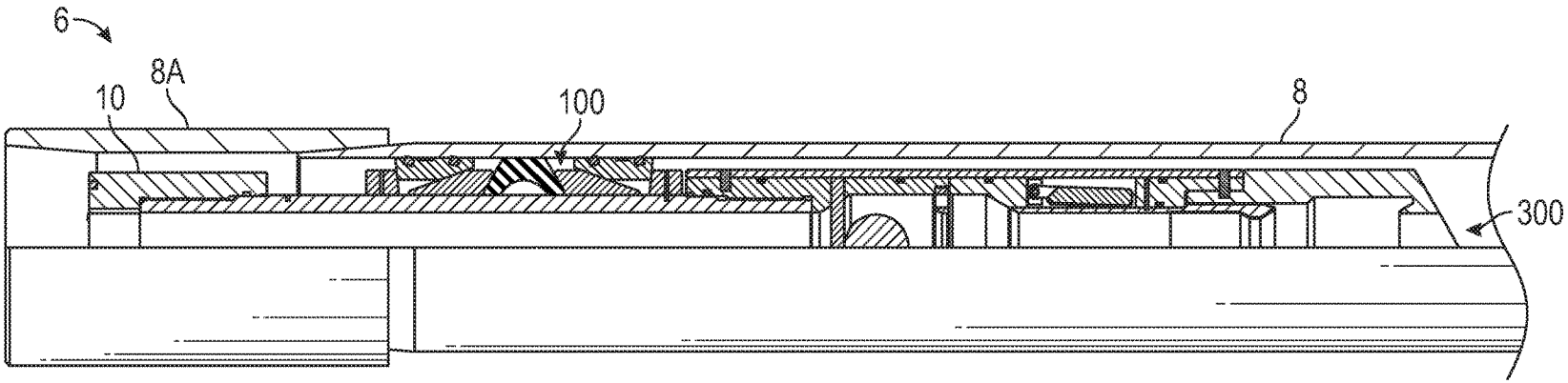
FIG. 18M is a schematic partial cross sectional view of the CAASA, upper valve assembly, and top shoe with the shoe installation fixture removed.

FIG. 18M is a schematic partial cross sectional view of the CAASA, upper valve assembly, and top shoe with the shoe installation fixture removed. The top shoe installation fixture can be removed from the CAASA 100 and the upper assembly 6 is now installed in the casing 8.

FIG. 19A is a schematic perspective view of an exemplary setting tool.

FIG. 19B is a schematic cross sectional view of a setting tool mandrel connector of the setting tool of FIG. 19A. The setting tool 400 generally includes a setting tool mandrel connector 402 that can be releasably coupled with a tension mandrel 408. The tension mandrel 408 may be supplied with a jack described herein, where the tension mandrel 408 can have an industry-standard thread that can fit in a suitable threaded bore 406 of the mandrel connector 402. The mandrel connector 402 further includes a threaded bore 404 that is sized and threaded to fit onto a threaded end of a CAASA 100. The setting tool 400 can be used to set the engagement of slips and sealing element of the CAASA 100 in a bore of the casing 8 in conjunction with a jack described herein.

FIG. 20A is a schematic perspective view of an exemplary top shoe installation fixture. FIG. 20B is a schematic cross sectional view of the top shoe installation fixture of FIG. 20A. The top shoe installation fixture 700 generally includes a tubular member having a first cylindrical portion 702 with a greater diameter than a second cylindrical portion 704. The interface between the first cylindrical portion and the second cylindrical portion forms a shoulder which can abut a top surface of the top shoe 10 to assist in installation. The second cylindrical portion 704 can further include one or more keys 706 that can engage corresponding key slots 26 in the top shoe to allow rotating the top shoe to couple onto the CAASA. The first cylindrical portion 702 further can include an opening 708 to insert a handle therethrough to use in rotating the fixture 700.

After the modular insert float system 2 is installed into a casing (that is, into one or more joints of a casing string) as described herein, the system is ready to be run into a wellbore according to normal casing running procedures. The float system 2 can be installed with the flapper valves in an "auto-fill" position to allow the casing to fill from the bottom as the casing is run into the wellbore. It is expected that most float system installations of the present invention will be run into the wellbore with the auto-fill feature activated. The flow paths described above through the valve assemblies when using the auto-fill feature are designed with sufficient flow area to help reduce significantly surge pressures on the wellbore formations during casing run in. The auto fill feature also can reduce the collapse pressure on the casing as fluid is allowed to enter the casing string and reduce differential pressure changes between fluid inside of the casing and outside of the casing. When the float system is installed and run with the auto-fill feature activated, the wellbore fluid can enter the casing through the bottom of the casing string. The fluid can flow up through both of the float valves in the valve assemblies of the float system with minimal pressure drop. This small pressure drop is possible due to the big bore flow areas through the float system.

Alternatively, the flapper valves can be run with the auto-fill feature deactivated. If the auto-fill feature has been deactivated, the customer has an option to provide buoyancy to the casing string while it is being lowered into the wellbore. The buoyancy adjustments may help to offset the load on the float system, casing, and drilling rig equipment caused by pressure from the fluids below the float system that are being pushed down the wellbore as the casing is inserted with the auto-fill feature deactivated.

While running casing into the hole, the wellbore fluid can enter through the internal bore of the tool. Often during casing run in operations, the casing crew will need to pump fluid down through the casing bore to condition the circulating fluid (often termed "mud") and establish a circulation up the annulus between the casing and open hole of the wellbore. The float system can allow this circulation without deactivating the auto-fill feature of the system by controlling the circulation rate that does not exceed shearing pressures for shearing pins or otherwise force restraining elements to disengage the surface, and not exceed pressures on the ball to deform and pass through restrictions in the valve assemblies. In at least one nonlimiting example, circulation rates of up to five barrels per minute are allowed. Circulation rates can be established as many times and for as long as needed.

After the casing reaches the desired depth, circulation rates can continue at the rate of up to five barrels/min. Once mud has been conditioned satisfactorily and cementing operations are ready to commence, the float system is then ready for cement pumping. There is no need to drop a ball from the surface to deactivate the auto-fill feature of the system. The self-contained ball described above is located inside the float system to deactivate the auto-fill feature. In at least one nonlimiting example, once circulation rates reach ten barrels/min or higher, the ball can self-release and pass through the valve assemblies, thereby deactivating the auto-fill feature and activating the flapper valves to seal against back flow from below the valves. An operator can continue pumping fluids or cement slurry as required. The float valves will reduce or prevent any flow back through the system as pressure differential increase from below. Additional pumping from above is possible. The operator can continue pumping with a cement plug down the casing until the cement plug bumps onto the top of the float system, specifically the top of the top shoe on the upper assembly. The cement plug will land and seal on the top of the top shoe, creating a "bottom" to pump against. The operator can continue pumping until a required casing pressure test is reached or the maximum bump pressure is reached.

The float can will hold the pressure differential of the cement in the annulus. After waiting on cement to set, the float system can be drilled out with conventional drilling techniques for floating equipment. The gripping elements on the top surface of the top shoe can assist in restraining rotation of the cement plug until the cement plug is drilled out. The composite materials can be drilled out and lightweight waste materials can be circulated back to the surface.

Figure 21A:
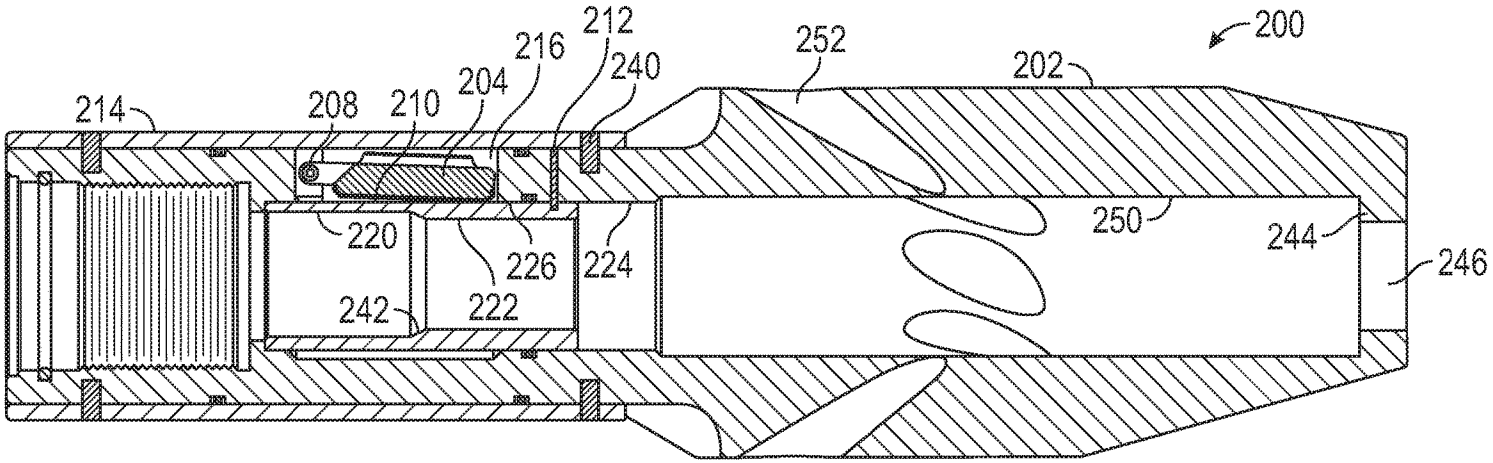
FIG. 21A is a schematic cross sectional view of another embodiment of the lower valve assembly in a pre-activated position.
Figure 21B:
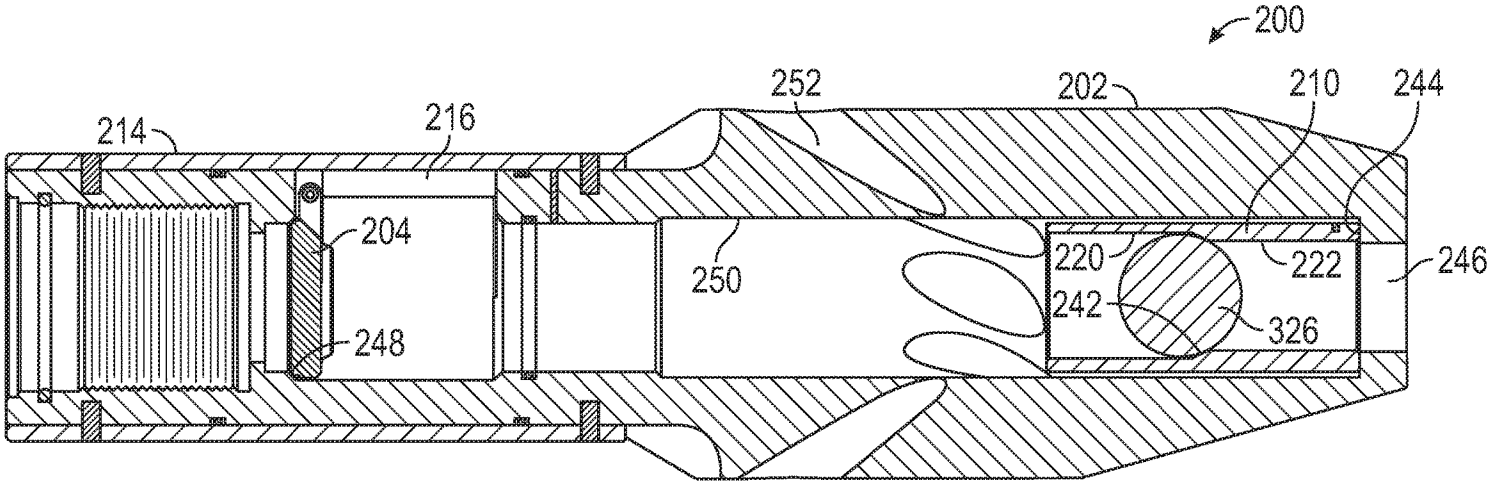
FIG. 21B is a schematic cross sectional view of the embodiment of FIG. 21A in an activated position.

FIG. 21A is a schematic cross sectional view of another embodiment of the lower valve assembly in a pre-activated position. FIG. 21B is a schematic cross sectional view of the embodiment of FIG. 21A in an activated position. The lower valve assembly 202 is similar to the embodiment shown in FIGS. 2A and 2B with a primary difference. The sleeve described below does not exit the nose of the lower valve housing, but rather forms a sealing surface to force fluid out of jet openings through the sidewall of the housing. The jet openings assist in increasing turbulent flow of the fluid outside of the housing.

More specifically, the lower valve assembly 200 includes a lower valve housing 202 coupled with an external case 214 around a portion of the housing that at least partially encapsulates components in the lower valve assembly. The case 214 can be coupled to the housing with one or more fastening pins or other restraining elements 240, including screws, such as set screws, adhesive applied to the relative components, and the like, and can be removable. The housing 202 includes a flapper slot 216 formed in the sidewall of the housing. A flapper valve 204, having a pair of flapper arms with a pin opening, can be rotatably coupled to the housing 202 within the flapper slot 216 with a pin 208 inserted into a pin opening of the slot. The flapper valve 204 can be biased into a closed position that is generally transverse to a bore 224 of the lower valve housing 202.

A sliding sleeve 210 can be slidably disposed within the housing bore 224. The sleeve 210 has an outer periphery 226 that is slightly smaller than the housing bore 224, so that it can slide within the bore 224 when activated. The sliding sleeve 210 is formed with a first bore 220 and a second bore 222 that is smaller in cross-sectional area than the first bore to form a sealing surface 242 therebetween. The smaller second bore 222 is configured lower than the first bore 220 when the valve assembly is installed in the casing for purposes described herein. The sleeve 210 is held in position temporarily by a restraining element 212 that is inserted through the housing 202. The restraining element 212 can be sheared or otherwise dislodged between the restrained components when sufficient pressure is exerted on the system as described below. The sleeve 210 is coupled in the housing bore 224 at a longitudinal position that blocks the flapper valve 204 from rotating to the biased closed position, generally transverse to the housing bore 224. Downstream of the housing bore 224 is a larger diameter bore 250 that allows the sleeve 210 after actuation to move more easily through lower portions of the lower valve housing 202. At the lower end of the housing 202, the bore 250 is restricted by a shoulder 244 that forms a bore 246 that is smaller in diameter than the bore 250. The outer periphery 226 of the sleeve is sized so that the sleeve will not pass through the bore 246, and so lodges against the shoulder 244. A plurality of jet openings 252 can be formed through a sidewall of the housing 202. In some embodiments, the jet openings can be angled upwardly and in some embodiments, the jet openings can be formed in a spiral pattern around the housing 202.

For activation, the ball 326, described above, can be dropped downhole so that the ball passes through the various components described above including the upper assembly 6 and into the lower assembly 4, shown in FIG. 1. As the ball 326 travels downhole to encounter the sleeve restrained in the position shown in FIG. 21A, the ball lodges against the sealing surface 242 of the sleeve 210. Pressure on the ball provides sufficient force against the sleeve to shear the restraining element 212. The pressure on the ball pushes the sleeve downward into the bore 250 to lodge against the shoulder 244. The pressure on the ball helps maintain the ball against the sealing surface 242 of the sleeve, thus blocking flow through the bore 246. Fluid flow into the housing 202 is forced through the jet openings 252. The jet openings 252 can be angled upwardly and/or in a spiral so that the flow of the fluid flows upwardly out of the jet openings in a spiral pattern to create more turbulence and more equal distribution of the flow around the outside of the lower valve housing 200.

The invention has been described in the context of preferred and other embodiments and not every embodiment of the invention has been described. Obvious modifications and alterations to the described embodiments are available to those of ordinary skill in the art. The disclosed embodiments are not intended to limit or restrict the scope or applicability of the invention conceived of by the Applicant, but rather, in conformity with the patent laws, Applicant intends to protect fully all such modifications and improvements that come within the scope or range of equivalent of the following claims.

What is claimed is:

1. A modular insert float system for use in a bore of a casing, the system comprising a first casing anchor and seal assembly configured to be inserted and coupled into the bore of the casing independent of being coupled to an end of the casing, the first casing anchor and seal assembly comprising:

a mandrel comprising two interchangeable ends, either end being configured to be coupled with a downhole component and wherein either end can be disposed toward a pin end of the casing and fit the same downhole component at the pin end; and a sealing element and a slip coupled to the mandrel.

2. The system of claim 1, wherein the downhole component comprises an end having an outside circumference larger than the casing bore that extends downhole of the pin end of the casing.

3. The system of claim 1, further comprising a shoe coupled to an end of the first casing anchor and seal assembly distal from the pin end.

4. The system of claim 1, further comprising a second casing anchor and seal assembly interchangeable with the first casing anchor and seal assembly and configured to fit the same downhole component on either end as the first casing anchor and seal assembly.

5. The system of claim 4, further comprising a different downhole component coupled to the second casing anchor and seal assembly than the downhole component coupled to the first casing anchor and seal assembly.

6. The system of claim 4, wherein:

one of the casing anchor and seal assemblies is coupled on one end to a first valve assembly and on the other end to a first shoe; and the other of the casing anchor and seal assemblies is coupled on one end to a second valve assembly different from the first valve assembly and on the other end to a second shoe different from the first shoe.

7. The system of claim 4, wherein:

one of the casing anchor and seal assemblies is coupled on an end to a first shoe; and the other of the casing anchor and seal assemblies is coupled on an end to a second shoe different from the first shoe.

8. The system of claim 4, wherein:

one of the casing anchor and seal assemblies is coupled on one end to a first valve assembly; and the other of the casing anchor and seal assemblies is coupled on one end to a second valve assembly, wherein the second valve assembly is disposed downhole of the first valve assembly and wherein the first valve assembly is configured to be actuated first by an actuator, and release the actuator to travel downhole to actuate the second valve assembly.

9. The system of claim 8, wherein the first valve assembly further comprises a ball holder coupled with a ball restrictor plate and configured to restrain a ball in a first direction to allow flow around the ball and restrain in a second direction different than the first direction and allow flow around the ball through a plate passage while the ball sealingly engages a plate restrictor.

10. The system of claim 1, further comprising a hydraulic setting tool configured to set the casing anchor and seal assembly inside the casing from the pin end of the casing.

11. The system of claim 1, wherein the downhole component extends partially out of the casing and comprises at least one jet opening formed through a sidewall of the downhole component.

12. A modular insert float system for use in a bore a casing, the system comprising:

a lower assembly coupled in the bore of the casing, comprising:

a lower casing anchor and seal assembly configured to be inserted and coupled into the casing bore independent of being coupled to an end of the casing, comprising:

a mandrel having two interchangeable ends configured to be coupled with a lower downhole component wherein either end can be disposed toward a pin end of the casing and fit the lower downhole component at the pin end; and a sealing element and a slip coupled to the mandrel; and the lower downhole component configured to be coupled to either end of the mandrel; and an upper assembly coupled in the casing bore distally from the casing pin end relative to the lower assembly, comprising:

an upper casing anchor and seal assembly configured to be inserted and coupled into the casing bore independent of being coupled to an end of the casing, comprising:

a mandrel comprising two interchangeable ends configured to be coupled with an upper downhole component wherein either end can be disposed toward the pin end of the casing and fit the upper downhole component at the pin end; and a sealing element and a slip coupled to the mandrel; and the upper downhole component being configured to be coupled to either end of the mandrel and being different than the lower downhole component.

13. A method of installing a modular insert float system into a bore of a casing, the method comprising:

installing a first downhole component on either end of a first casing anchor and seal assembly configured to be inserted and coupled into the casing bore independent of being coupled to an end of the casing, comprising:

a mandrel comprising two interchangeable ends configured to be coupled with the first downhole component wherein either end can be disposed toward a pin end of the casing and fit the first downhole component at the pin end; and a sealing element and a slip coupled to the mandrel;

inserting the first casing anchor and seal assembly a predetermined distance into the bore of the casing; and setting the first casing anchor and seal assembly to engage the bore of the casing independent of being coupled to an end of the casing.

14. The method of claim 13, further comprising:

installing a second downhole component different than the first downhole component on either end of a second casing anchor and seal assembly that is interchangeable with the first casing anchor and seal assembly;

inserting the second casing anchor and seal assembly a predetermined distance into the bore of the casing; and setting the second casing anchor and seal assembly to engage the bore of the casing independent of being coupled to an end of the casing.

15. The method of claim 13, wherein setting the casing anchor and seal assembly comprises hydraulically setting the casing anchor and seal assembly.

* * * * *